US010835087B2

(12) United States Patent
Duarte et al.

(10) Patent No.: US 10,835,087 B2
(45) Date of Patent: Nov. 17, 2020

(54) ON DEMAND WET WIPE DISPENSING DEVICE WITH WIPE ACTUATED PUMP

(71) Applicant: THE CLOROX COMPANY, Oakland, CA (US)

(72) Inventors: Aidee Duarte, Pleasanton, CA (US); Ryan Christian, Morgan Hill, CA (US); Ashby Shaw, Morgan Hill, CA (US); Brian Crane, Morgan Hill, CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 16/103,786

(22) Filed: Aug. 14, 2018

(65) Prior Publication Data

US 2020/0054178 A1 Feb. 20, 2020

(51) Int. Cl.
*A47K 10/42* (2006.01)
*A47K 10/44* (2006.01)

(52) U.S. Cl.
CPC ..... *A47K 10/44* (2013.01); *A47K 10/422* (2013.01)

(58) Field of Classification Search
CPC ..... A47K 10/34; A47K 10/44; A47K 10/422; A47K 10/426; A47K 2010/3233; A47K 2010/3273; A47K 2010/3286
See application file for complete search history.

(56) References Cited

U.S. PATENT DOCUMENTS 4,598,664 A 7/1986 Hamlin
4,667,846 A 5/1987 Marceau
5,988,371 A 11/1999 Paley et al.
6,085,899 A * 7/2000 Thorsbakken ..... A47K 10/32 206/205
6,601,737 B1 8/2003 Sandler
7,318,949 B2 1/2008 Shadrach
7,497,351 B2 3/2009 Amundson et al.
7,654,412 B2 2/2010 Amundson et al.
7,984,832 B2 7/2011 Pivonka et al.
8,006,864 B2 8/2011 Fryan et al.
2007/0289988 A1 12/2007 Sosalla et al.
2008/0138143 A1 6/2008 O'Connell
2008/0245821 A1 10/2008 Itzkowitz et al.
(Continued)

FOREIGN PATENT DOCUMENTS

CN 103027622 B 5/2015
WO 2018022621 A1 2/2018

*Primary Examiner* — Gene O Crawford
*Assistant Examiner* — Kelvin L Randall, Jr.
(74) *Attorney, Agent, or Firm* — Erin Collins

(57) ABSTRACT

In one example, a wipe dispensing system includes a housing that defines an internal wipe storage area, a lid connected to the housing, a fluid reservoir disposed within the housing, a pump in fluid communication with the fluid reservoir, a fluid discharge manifold in fluid communication with the pump and located proximate a wipe dispensing path. The lid is operably disposed with respect to the pump such that depression of the lid causes the pump to discharge fluid from the fluid discharge manifold, and also causes dispensation of a portion of a wipe from the housing, and a return of the lid from a depressed position to a 'ready' position causes the pump to discharge fluid from the fluid discharge manifold, and also causes dispensation of portion of a wipe from the housing.

5 Claims, 16 Drawing Sheets

(56) References Cited

U.S. PATENT DOCUMENTS

| | | | | |
|---|---|---|---|---|
| 2010/0032338 | A1* | 2/2010 | Mueller | A45C 5/005<br>206/570 |
| 2010/0032443 | A1* | 2/2010 | Mueller | A45D 34/00<br>221/2 |
| 2010/0301157 | A1* | 12/2010 | Keily | A47K 10/34<br>242/564.1 |
| 2013/0105618 | A1* | 5/2013 | Hjort | A47K 10/38<br>242/598.6 |
| 2015/0173573 | A1 | 6/2015 | Dunn et al. | |
| 2015/0196173 | A1 | 7/2015 | Hoefte et al. | |
| 2015/0366416 | A1 | 12/2015 | Hoefte et al. | |
| 2017/0333586 | A1 | 11/2017 | Kang et al. | |
| 2018/0010080 | A1 | 1/2018 | Kang et al. | |

* cited by examiner

ON DEMAND WET WIPE DISPENSING DEVICE WITH WIPE ACTUATED PUMP

RELATED APPLICATIONS

This application is related to U.S. patent application Ser. No. 15/604,520, filed on May 24, 2017 entitled APPARATUS FOR MULTI DOSING OF WIPE AT POINT OF DISPENSING. This application is also related to Ser. No. 15/604,497, entitled ON DEMAND WET WIPE DISPENSING DEVICE, filed on May 24, 2017. The aforementioned applications are both incorporated herein in their entirety by this reference.

FIELD OF THE INVENTION

Embodiments of the present invention generally concern disposable wipe dispensing devices and associated components and methods. More particularly, at least some embodiments of the invention relate to an on demand wet wipe dispensing device that is configured so that as a wipe is pulled from the device during a wipe dispensing process, the movement of the wipe causes one or more liquids to be dosed onto the wipe.

BACKGROUND

Various wipe dispensing devices exist that store a roll of wipes which can be dispensed one at a time by a user. Typically, the wipes are perforated at regular intervals. As such, the wipes each have a predetermined length, and can be easily separated from each other as they are dispensed. The wipes may be dosed in some fashion, such as by a pumping mechanism, at some point prior to being dispensed from the dispensing device. However, conventional dosing systems and other devices used for dosing have proven problematic.

For example, because conventional dosing systems are typically configured to dispense fluid only in discrete, and predetermined, volumes, they are essentially limited to use with perforated wipes that all have the same length. That is, because dose volume is at least loosely based on the size of the wipe, the dose volume for each wipe is known in advance. Thus, while conventional dosing systems have a relatively simple configuration that repeatedly doses the known volume each time a wipe is dispensed; such dosing systems can typically only be employed with wipes of a known, and consistent, length.

Moreover, limiting a consumer to the use of perforated wipes may result in inefficient use of the wipes and the dosing fluids. That is, for a given job, too many, or too few, wipes may be dispensed because the wipe dispensing system does not provide the user with the ability to dispense a dosed wipe whose length is determined on an as-needed basis by the user at the time of dispensing. This may result in an unsatisfactory user experience.

Another concern with conventional dosing systems is related to the fact that perforated wipes may be obtained in various lengths, depending upon the needs of the consumer. That is, while all the wipes within a given roll have generally the same length, some rolls have perforated wipes of one length, while other rolls have perforated wipes of a different length. However, because conventional dosing systems are typically configured for use with perforated wipes of a specified length, they are not well suited for use with perforated wipes of other lengths, whether those wipes are longer or shorter than the specified length targeted by the dosing system.

Problems such as those noted above are not easily resolved. Significant changes would likely be required to conventional dosing systems in order to enable those systems to be used with wipes of different and/or unspecified lengths. Such changes, which may not be readily implemented, if at all, would likely increase the cost and complexity of those systems.

In light of problems such as those noted above, it would be useful to provide a wipe dispensing system that can be employed to dose wipes of various lengths and/or lengths that are determined on an as-needed basis by a user at the time of dispensing. It would also be useful to provide a wipe dispensing system that can be employed to dose both perforated and unperforated wipes. Finally, it would be useful to provide a wipe dispensing system that doses a wipe based on a length of the wipe, even if the length of the wipe is indeterminate.

ASPECTS OF AN EXAMPLE EMBODIMENT

Embodiments within the scope of the invention may be effective in overcoming one or more of the problems in the art, although it is not required that any embodiment resolve any particular problem(s). In general, embodiments of the present invention concern disposable wipe dispensing systems and associated components and methods. More particularly, at least some embodiments of the invention relate to an on demand wet wipe dispensing device that doses wipes based on the length of the wipe, and which can be used with perforated wipes, unperforated wipes, and wipes whose length is specified at the point of use by a user.

In some example embodiments, an on demand wipe dispensing system, which may be referred to herein as simply a wipe dispensing system, is provided that is configured to hold wipes and one or more dosing fluids, and that includes one or more pumps configured to pump the dosing fluids. The wipe dispensing system is configured so that operation of one or more dosing pumps may be effected by linear movement of a wipe, such as occurs during a wipe dispensing process. Because operation of a dosing pump is linked to linear movement of the wipe, the dosing pump continues to operate while the wipe is experiencing linear motion, such as when the wipe is being pulled from the wipe dispensing system during a wipe dispensing process. Correspondingly, when linear movement of the wipe stops, the dosing pump ceases operation.

In operation, a user can dispense a wipe of any desired length from the wipe dispensing system. Because the dosing pump continues to operate as a result of the wipe being dispensed from the wipe dispensing system, the amount of fluid dispensed on the wipe is a function of the length of the wipe, even if dispensation of the wipe should be interrupted for some reason, and later resumed, and even if the length of the wipe is not predetermined. When the user has obtained a dosed wipe of the desired length, the dosed wipe can then be separated from the roll of wipes and used by the user.

Advantageously then, example embodiments of the invention are directed to a wipe dispensing system configured to operate such that a dosed wipe of any desired length can be created on an as-needed basis by a user.

BRIEF DESCRIPTION OF THE DRAWINGS

In order to describe the manner in which at least some aspects of this disclosure can be obtained, a more particular description will be rendered by reference to specific embodiments thereof which are illustrated in the appended drawings. Understanding that these drawings depict only example embodiments of the invention and are not therefore to be considered to be limiting of its scope, some example embodiments of the invention will be described and explained with additional specificity and detail through the use of the accompanying drawings, in which.

DETAILED DESCRIPTION OF SOME EXAMPLE EMBODIMENTS

Reference will now be made in detail to aspects of various embodiments of the present disclosure, examples of which are illustrated in the accompanying drawings. While described in conjunction with these embodiments, it will be understood that they are not intended to limit the disclosure to these embodiments.

A. General Aspects of Some Example Embodiments

Figure 1:
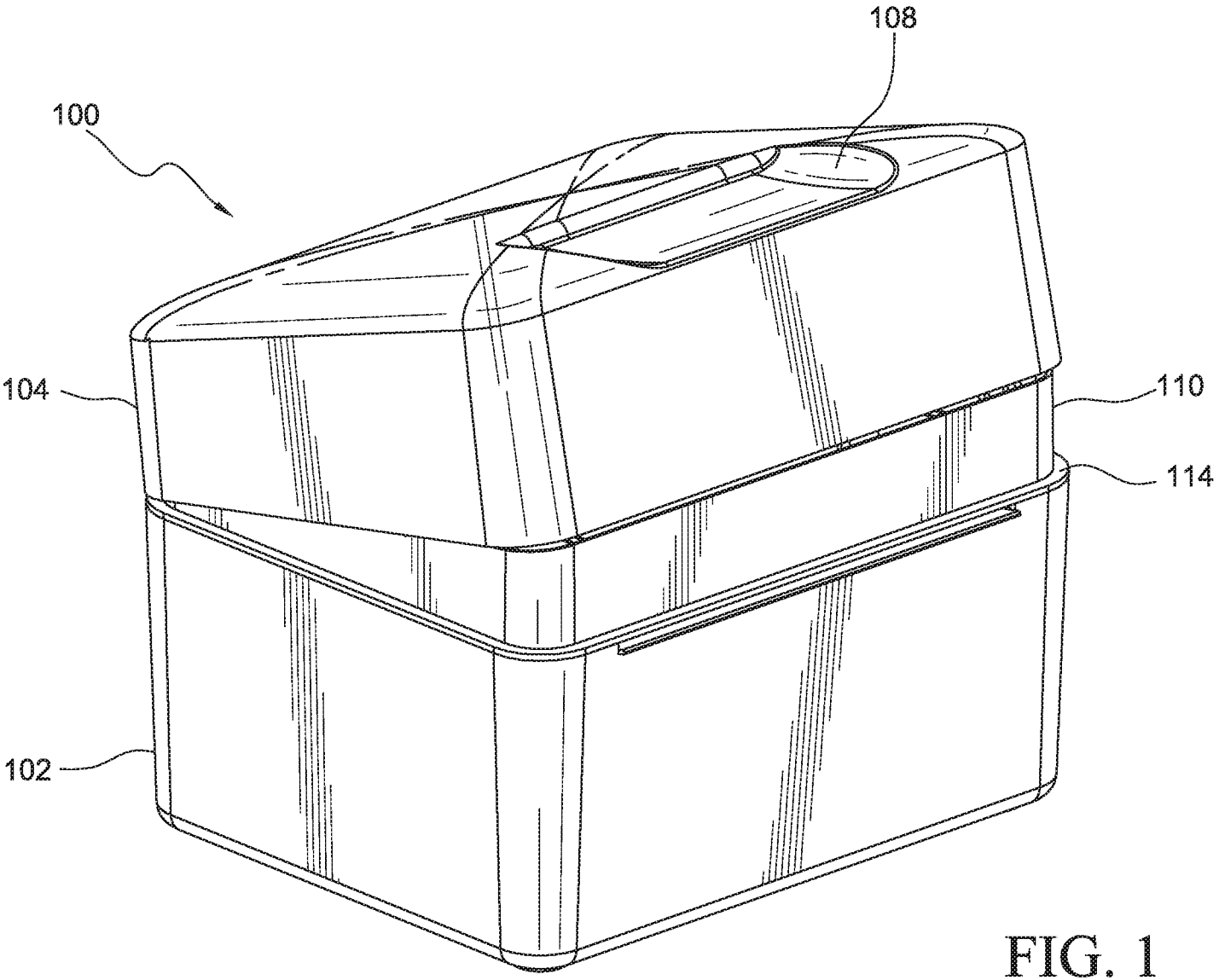
FIG. 1 is a front perspective view of an example wipe dispensing system.
Figure 2:
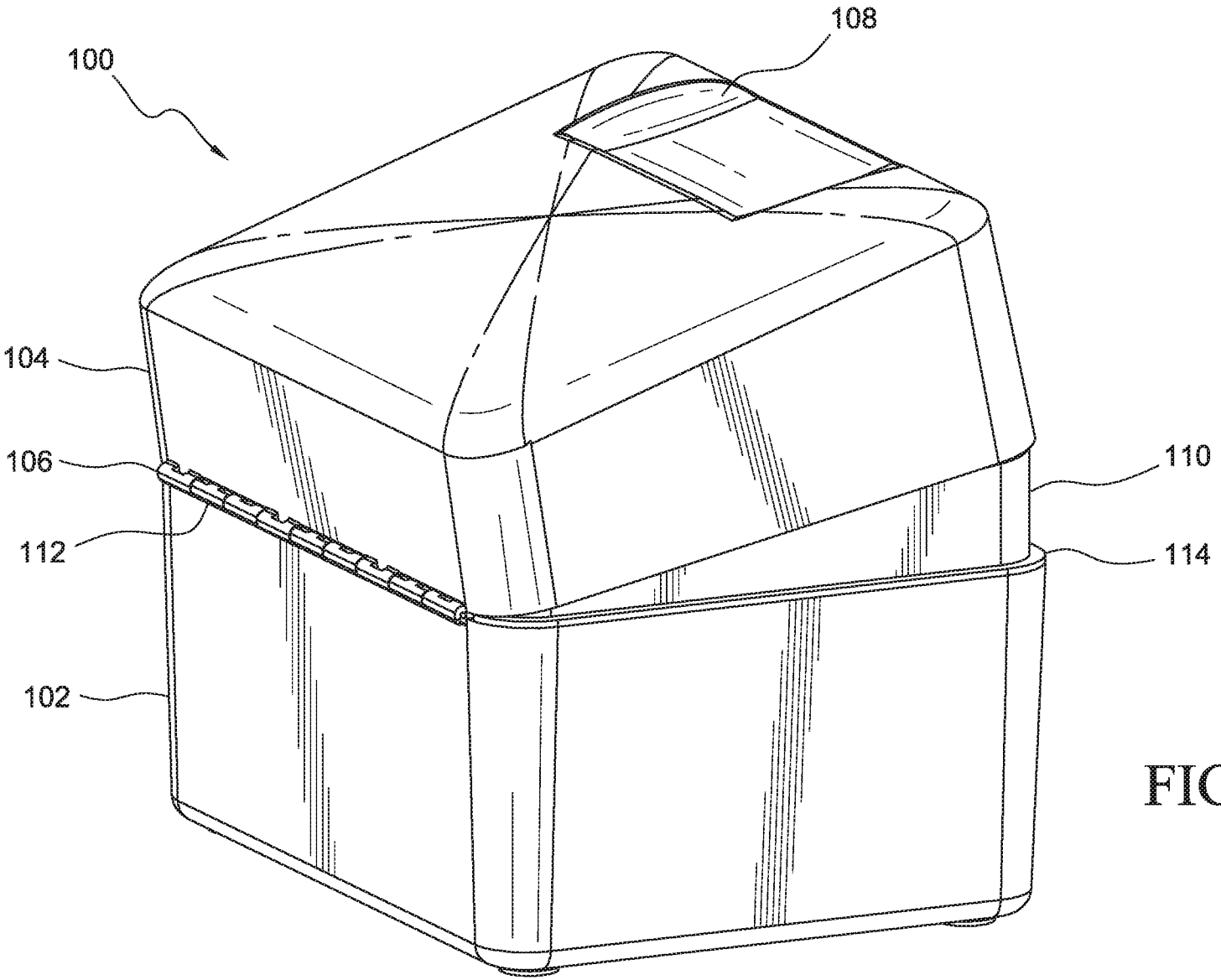
FIG. 2 is a rear perspective view of a wipe dispensing system.
Figure 3:
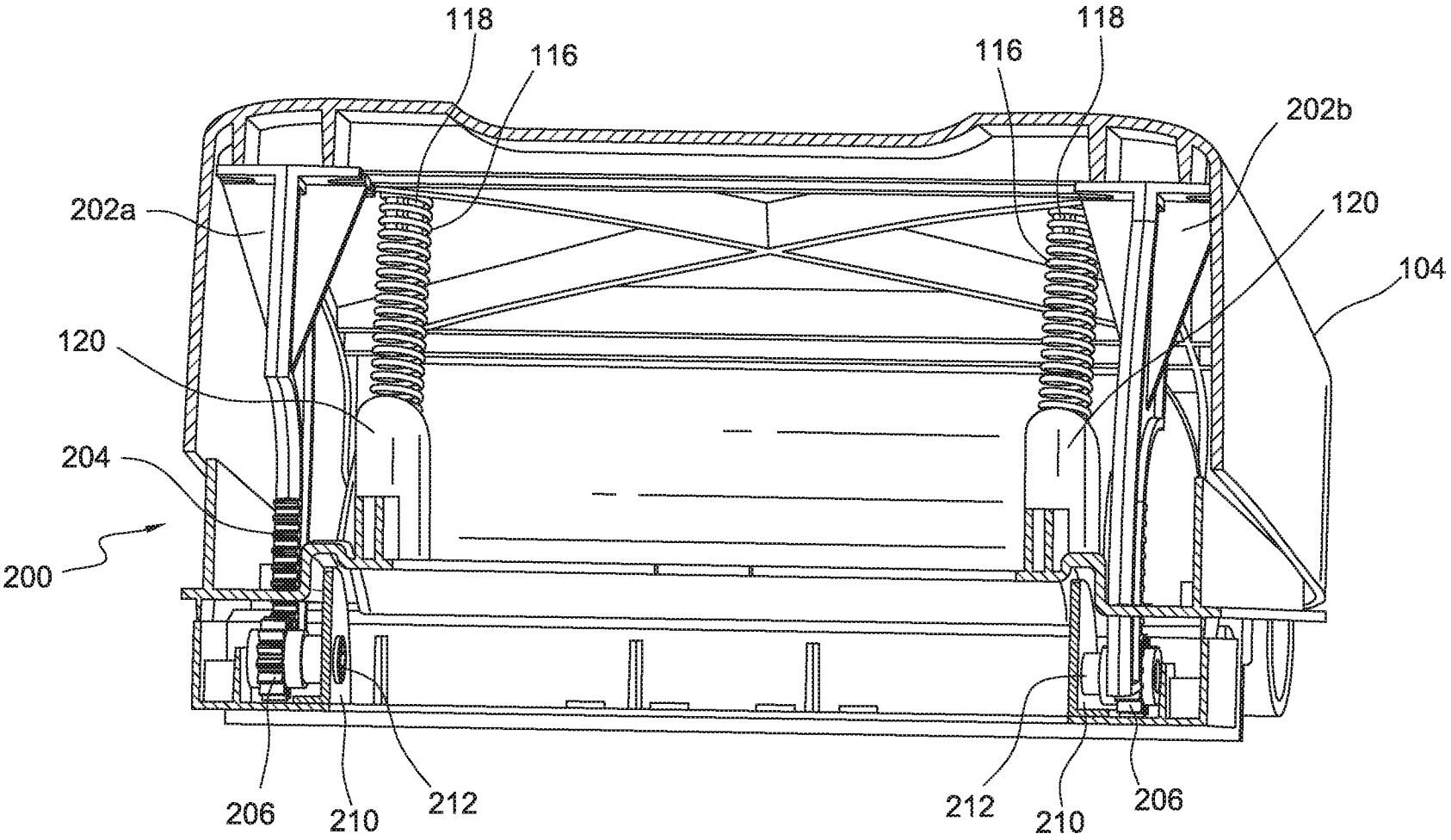
FIG. 3 is a partial section view of the lid and other components of a wipe dispensing system.

Directing attention first to FIGS. 1-3, details are provided concerning an example on demand wet wipe dispensing system, one example of which is denoted generally at 100. For brevity, embodiments of an on demand wet wipe dispensing system may be referred to herein simply as a wipe dispensing system. As indicated, the wipe dispensing system 100 includes a housing 102, and a lid 104 configured to mate with the housing 102. The housing 102 and lid 104 can be made of plastic and/or any other suitable material(s). The lid 104 may have a clamshell configuration and, as such, can be rotatably connected to an edge of the housing 102 by way of a hinge 106. As well, the lid 104 may include a user interface portion 108, in the form of a depression for example, that a user can depress to operate the wipe dispensing system 100.

In addition to the housing 102 and lid 104, the wipe dispensing system 100 further includes a housing extension 110 that is rotatably connected to the same edge of the housing 102 as the lid 104, by way of a hinge 112. As shown, the hinge 112 and hinge 106 may be configured and arranged so that the housing extension 110 and the lid 104 both rotate about the same axis. As indicated in FIGS. 1 and 2, the housing extension 110 may include a flange 114 or other comparable structure that rests on an upper edge of a vertical wall of the housing. The flange 114 may extend around part or all of three sides of the housing extension 110, namely, the front and the two sides. As a result of the configuration and positioning of the flange 114, the housing extension 110 is prevented from rotating downward when the lid 104 is depressed, notwithstanding that depression of the lid 104 causes the exertion of a force on the housing extension 110.

As disclosed elsewhere herein, the housing extension 110 serves as a cover for various internal components of the wipe dispensing system 100. When there is a need to access those internal components, the lid 104 can be rotated, counter-clockwise from the perspective of FIG. 1, into an open position, and then the housing extension 110 can be similarly rotated to an open position, either at the same time as the lid 104 or subsequently, thus exposing various internal components of the wipe dispensing system 100. Movement of the lid 104 and housing extension 110 in the manner just described also enables access to the interior cavity (not shown) where a roll of wipes 115 is stored (see, e.g., FIGS. 5-7). Thus, a user can remove an exhausted roll 115 and replace it with a new one. In a similar manner, the user can refill the reservoir(s) that hold the fluid(s) to be dosed onto the wipes as the wipes are dispensed.

With reference now to FIG. 3, the lid 104 can be biased open, or upward, into the 'ready' position shown in FIGS. 1 and 2 by one or more resilient elements 116, such as one or more helical springs for example. When the lid 104 is in the 'ready' position, the resilient elements 116 may be in a substantially undeformed state, that is, uncompressed, or only slightly compressed due to the weight of the lid 104 acting downward on the resilient elements 116. That is, a force exerted by the resilient elements 116 acts to bias the lid 104 into the 'ready' position. This force may be expressed in some embodiments as $F=kX$, where the force 'F' is a function of a spring constant 'k' and a distance of displacement 'x' (i.e., the reduction in length of the resilient element 116 due to the downward movement of the lid 104).

In order that the resilient elements 116 are retained in position between the lid 104 and housing extension 110, the lid 104 and housing extension 110 may include respective structural elements that engage and retain the resilient elements 116. For example, and as shown in FIG. 3, the lid 104 may include downwardly extending pins 118 aligned so that a lower end of each pin 118 is received in an upper end of a respective resilient element 116, that is, in the interior of the resilient element 116. The pins 118 may be integral with the lid 104, but that is not required. As further indicated in FIG. 3, the lower end of each resilient element 116 is received in a respective recess 120 defined by the housing extension 110. The recesses 120, which may be generally cylindrical in shape, may be integral with the housing extension 110, but that is not required.

Thus, the pins 118 and recesses 120 cooperate with each other to retain the resilient elements 116 in position. Moreover, because the housing extension 110 is prevented from downward movement due to the configuration and positioning of the flange 114, depression of the lid 104 downward toward the housing extension 110 overcomes the bias imposed by the resilient elements and thus acts to compress the resilient elements 116. When the downward force on the lid 104 is released, the compressed resilient elements then bias the lid 104 upward so as to return the lid 104 to the 'ready' position. In some embodiments, the lid 104 and housing extension 110 may be connected by a damping mechanism (not shown) that provides for a controlled movement of the lid 104 from a depressed position back to the 'ready' position. Such a controlled movement of the lid 104 is a movement of the lid 104 to the 'ready' position that takes place relatively more slowly than if the resilient element(s) 116 were permitted to act freely in returning the lid 104 to the 'ready' position.

Figure 6:
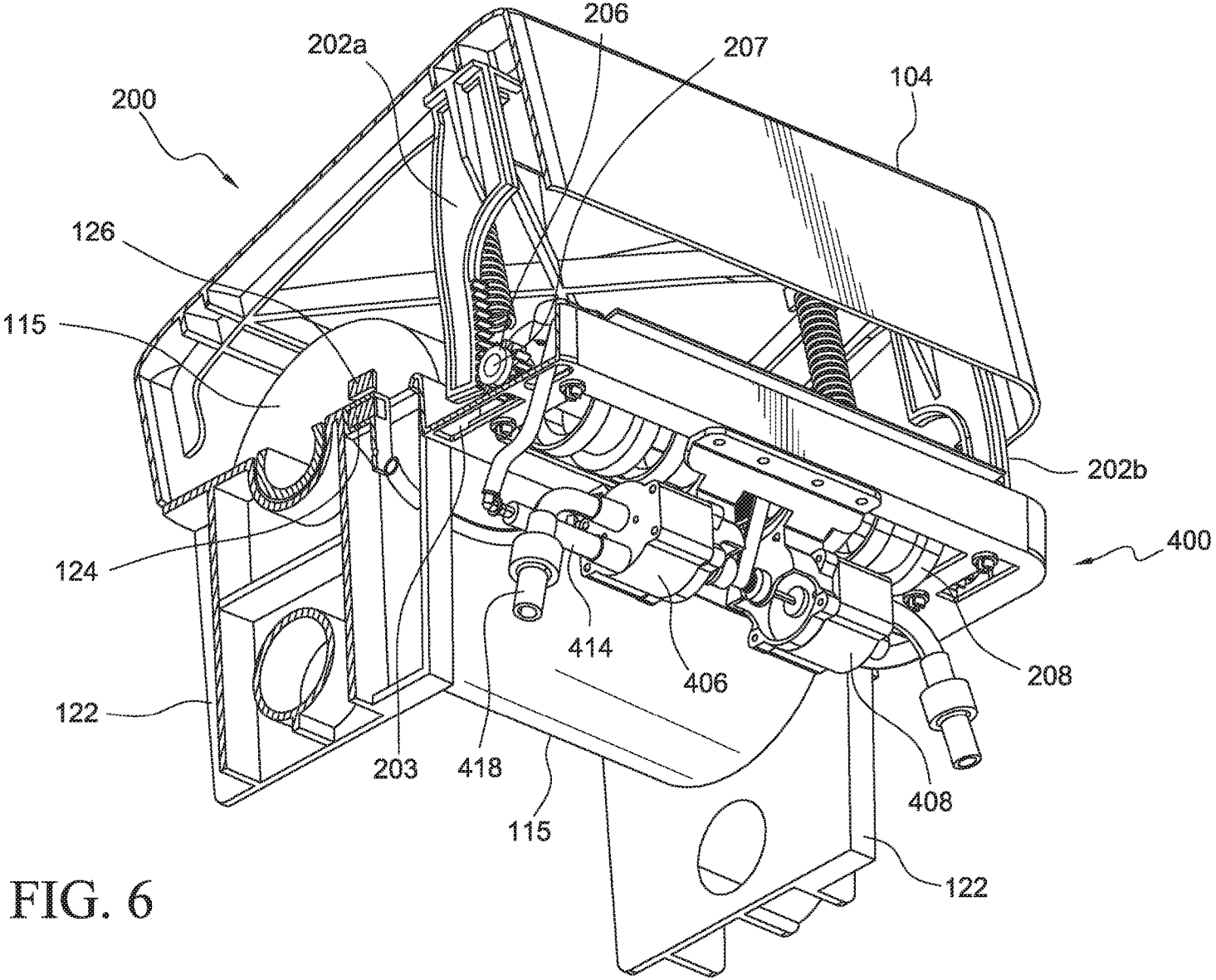
FIG. 6 is a bottom perspective view disclosing various internal components of a wipe dispensing system.
Figure 7:
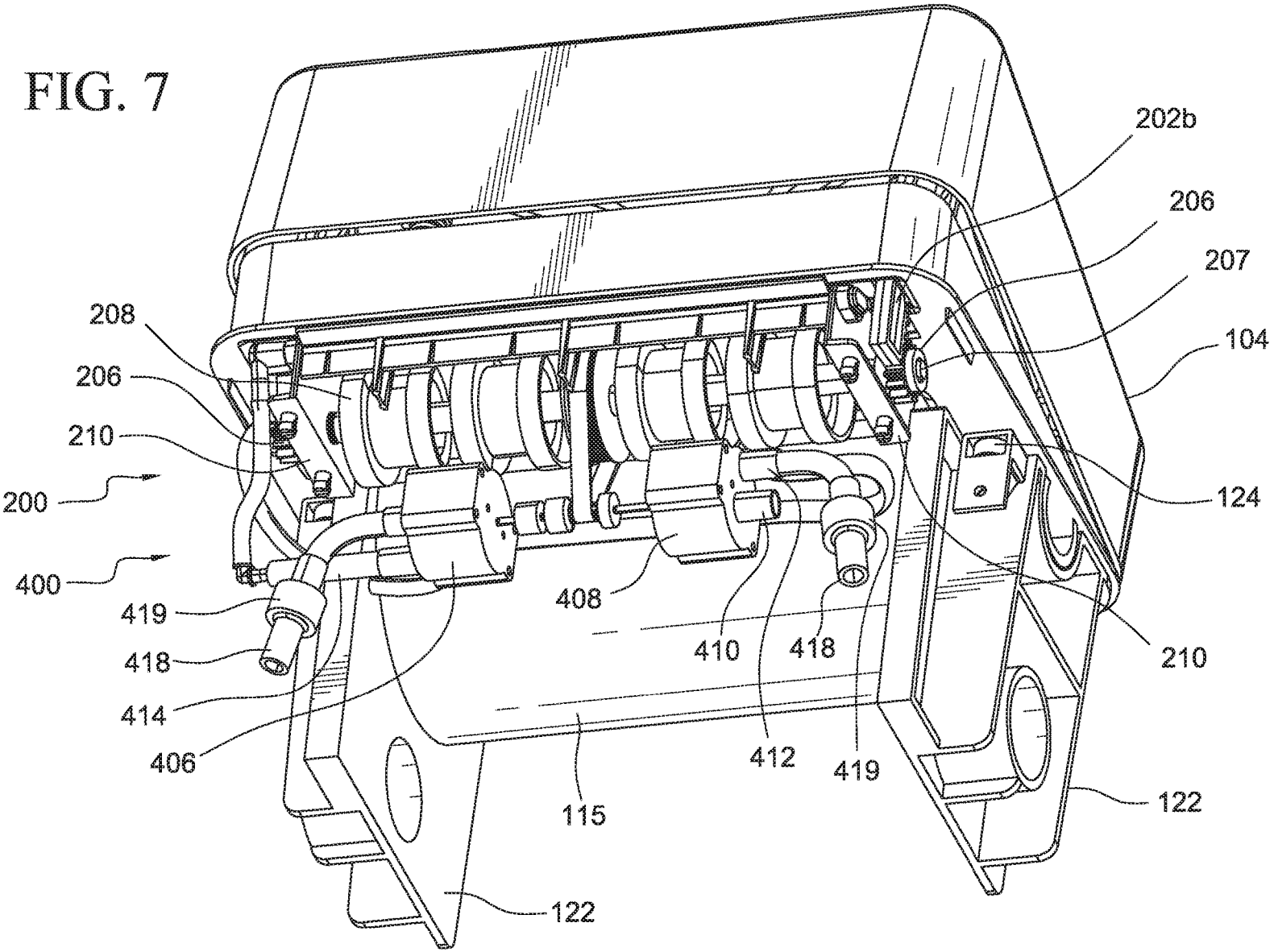
FIG. 7 is another bottom perspective view disclosing various internal components of a wipe dispensing system.

Finally, and with reference to FIGS. 6 and 7 in particular, the interior frame 122 which supports the roll of wipes 115 may house a magnetic element 124, one or both sides of the housing 102. The magnetic elements 124 are configured and arranged to interact with corresponding magnetic elements 126 housed by the housing extension 110. This arrangement, in which the magnets 124 and 126 are attracted to each other, may help to retain the housing extension 110 in position relative to the housing 102. This may be useful, for example, when the lid 104 is being returned to the 'ready' position and the housing extension 110 may have a tendency to move upward in response. As well, the arrangement of magnets 124 and 126 may also be helpful in retaining the housing extension 110 in the position indicated in FIG. 1 for example, when the lid 104 is opened.

B. Aspects of an Example Wipe Dispensing Mechanism

Figure 4:
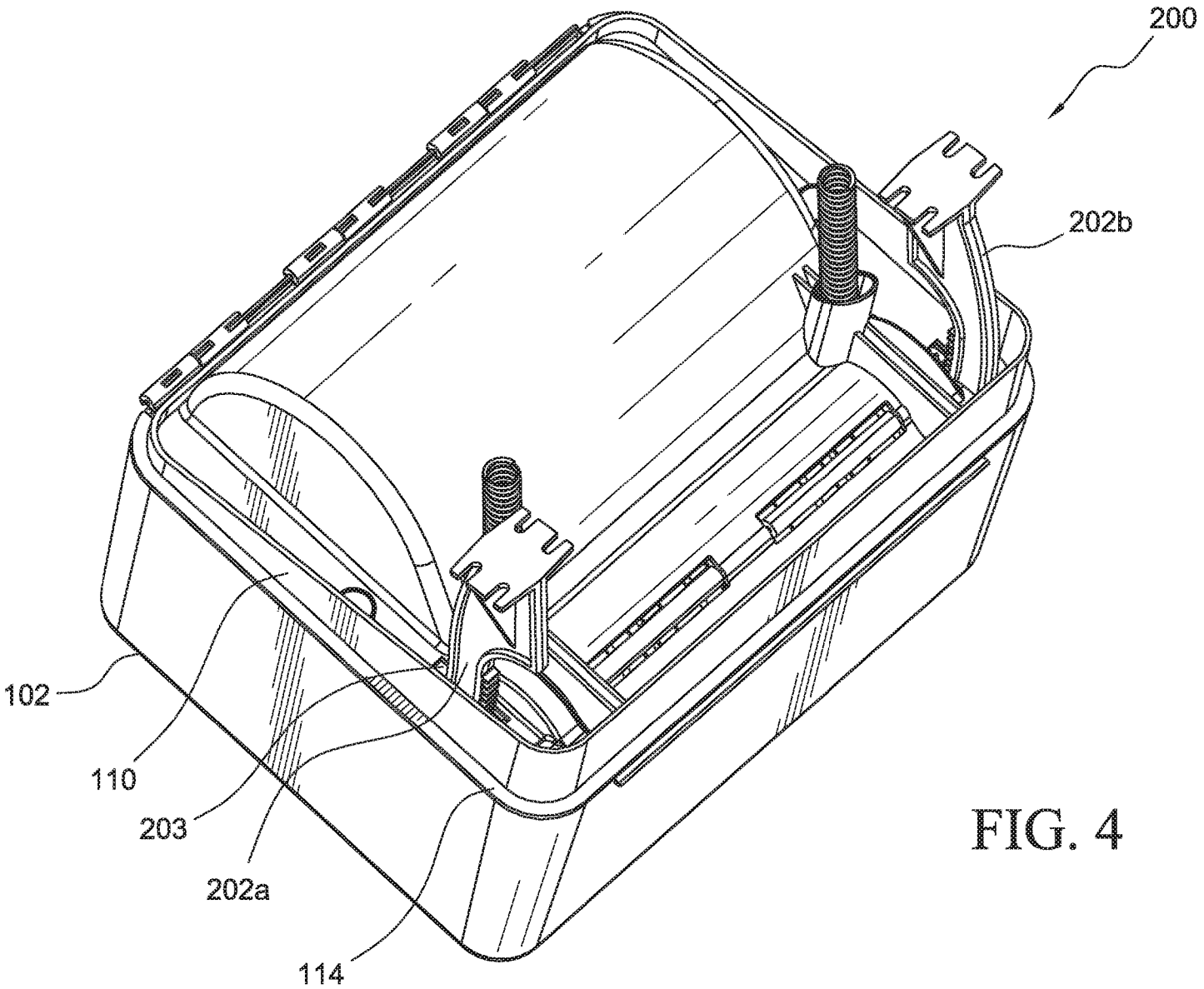
FIG. 4 is a top perspective view of a wipe dispensing system with the lid removed.
Figure 5:
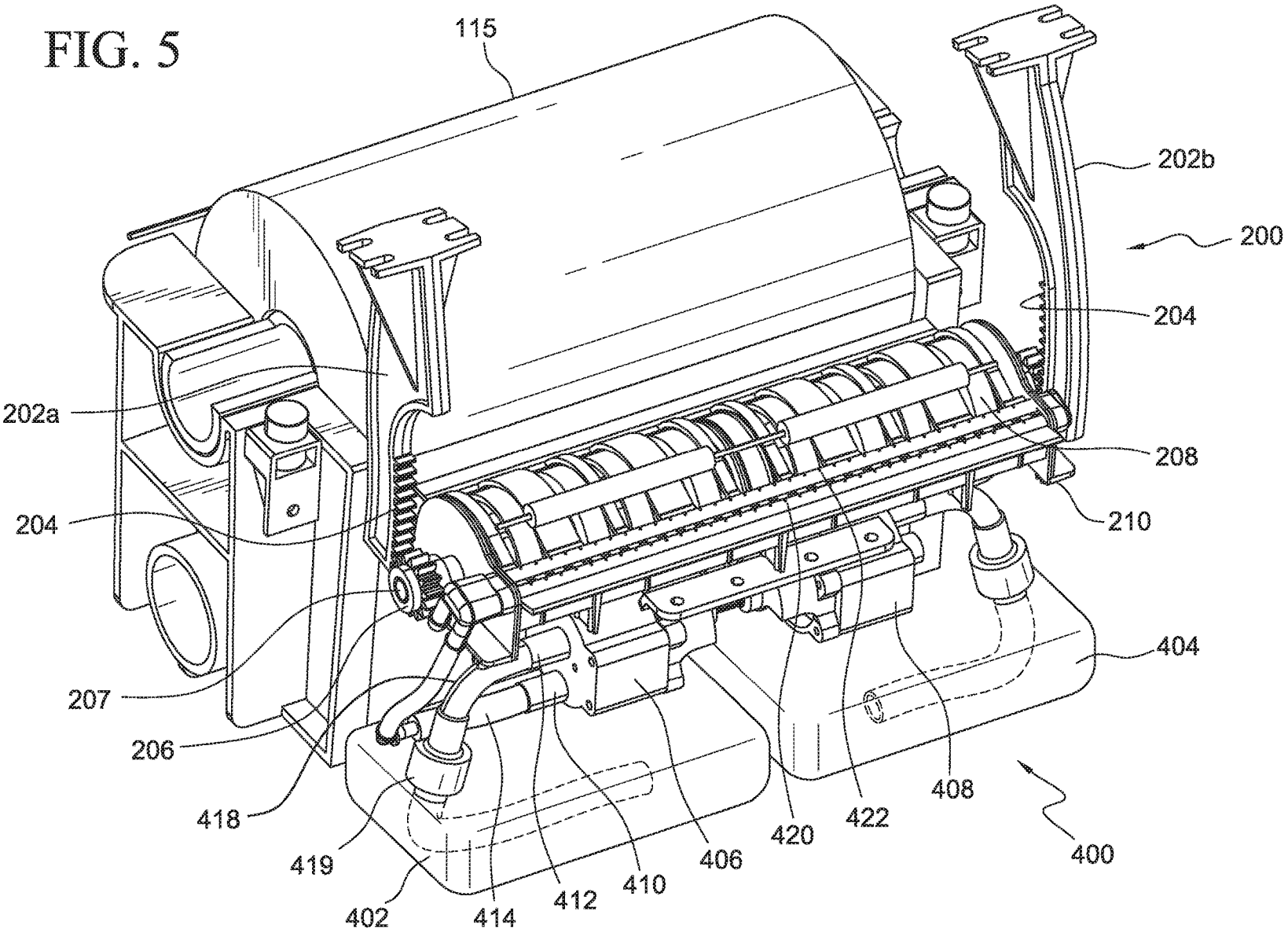
FIG. 5 is a top perspective view disclosing various internal components of a wipe dispensing system.

With continuing reference to FIG. 3, and turning next to FIGS. 4-9, details are provided concerning wipe dispensing mechanisms, one example of which is denoted generally at 200. As shown in FIGS. 3-8, the lid 104 can include first and second drive gears 202*a* and 202*b*, respectively, that can be integral with the lid 104, although that is not required and, in some embodiments, the drive gears 202*a* and 202*b* are removably attached to the lid 104 with fasteners, such as screws for example. In the illustrated embodiment, one or both of the drive gears 202*a* and 202*b* are rack gears, although other types of gears can alternatively be used for one or both of the drive gears 202*a* and 202*b*. As indicated in FIGS. 3-5, the drive gears 202*a* and 202*b* may each extend through respective openings 203 defined in the floor of the housing extension 110, at least when the lid 104 is in a fully depressed state.

The drive gears 202*a* and 202*b* are arranged so that, as best shown in FIG. 5, the respective sets of teeth 204 of the drive gears 202*a* and 202*b* face in opposite respective directions. That is, as best showing in FIG. 5, the teeth 204 of the drive gear 202*a* face toward the front of the wipe dispensing system 100, while the teeth 204 of the drive gear 202*b* face toward the rear of the wipe dispensing system 100.

Figure 8:
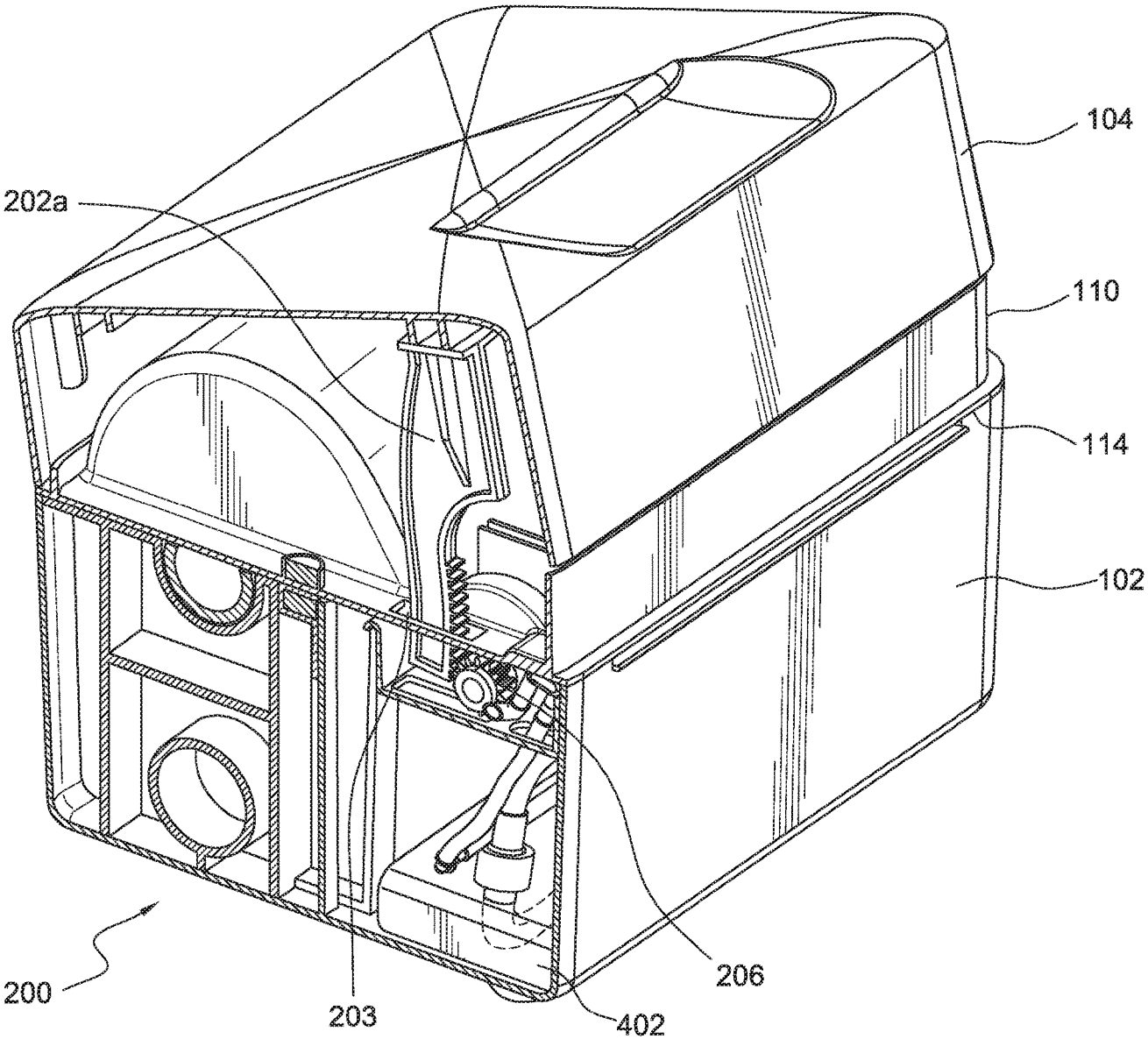
FIG. 8 is a side section view detail indicating various internal components of a wipe dispensing system.

When the lid 104 is connected to the housing 102 as shown in FIGS. 6-8, the drive gears 202*a* and 202*b* are each configured to engage a corresponding driven gear 206. The driven gears 206 are each connected to a respective end of a shaft 207 that supports a roller 208. Thus, by virtue of the engagement of the driver gears 202*a* and 202*b* with respective driven gears 206, both upward movements and downward movements of the lid 104 cause the roller 208 to rotate. Further details concerning this configuration and operation are disclosed in connection with the discussion of FIG. 9.

Because, as disclosed elsewhere herein, the roller 208 forms part of a wipe path along which wipes from the roll of wipes 115 travel, dispensation of a wipe from the wipe dispensing system 100 can thus be effected both as the lid 104 moves up, and as the lid 104 moves down. In this way, the motion of the lid 104 is employed in an efficient manner. By way of contrast, if a roller were only able to rotate on the downstroke of a lid, a user desiring a wipe of a particular length would be required to depress that lid 2× as many times as would be required to obtain a wipe of the same length with the disclosed embodiments. Moreover, because the resilient elements 116 bias the lid 104 to the 'ready' position, the lid 104 is automatically returned to the 'ready' position without requiring any action on the part of the user. Among other things then, the disclosed embodiments may be relatively easy to use, and relatively efficient in their operation.

Figure 9:
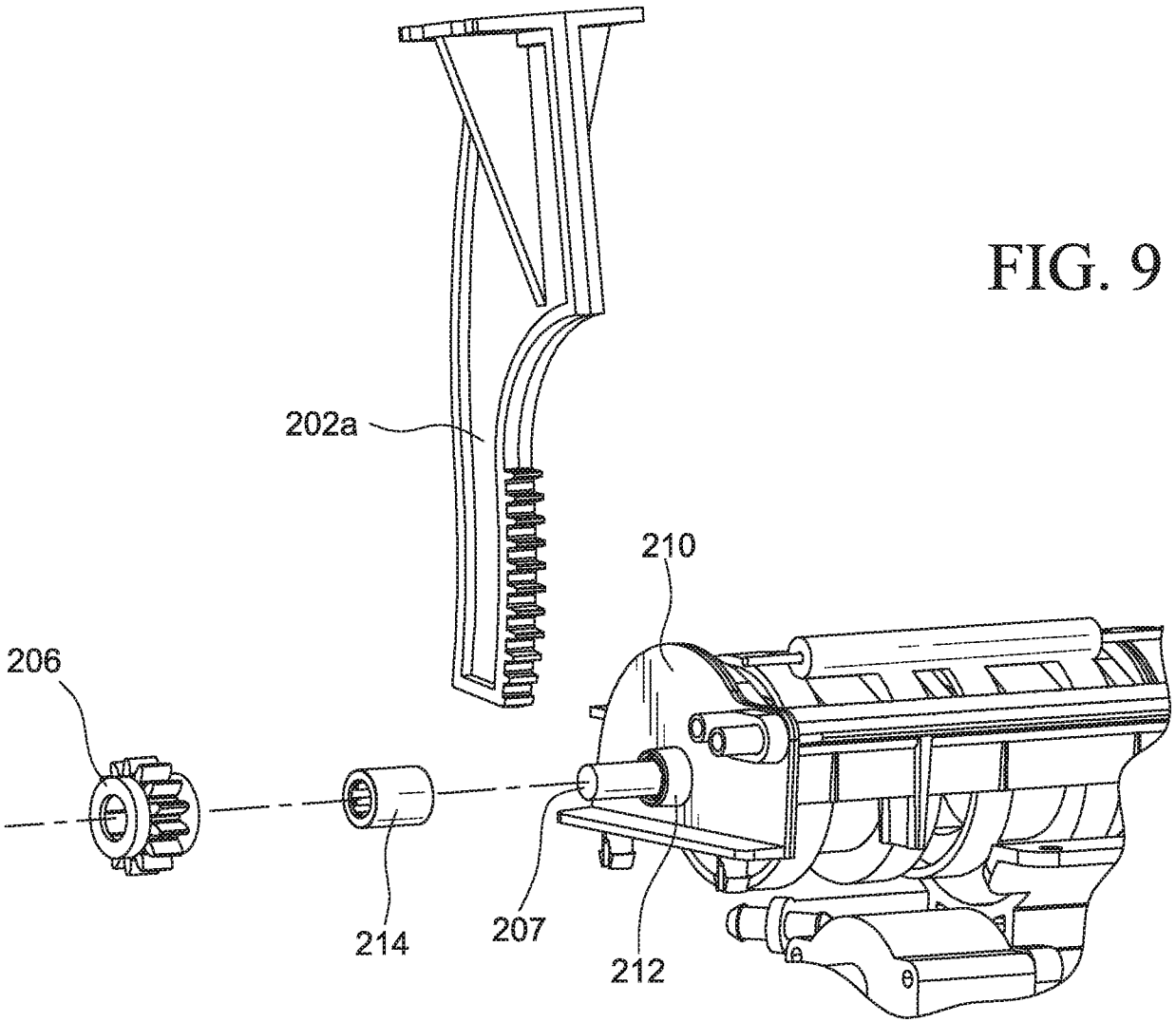
FIG. 9 is an exploded view of a portion of a wipe dispensing system.

With continued reference to FIGS. 3-8, and particular reference now to FIG. 9 as well, further details are provided concerning the configuration and operation of the roller 208 and various associated components. In particular, the roller 208 may be fixed to the shaft 207 so that the roller 208 and shaft 207 rotate in unison with each other. In some embodiments, the shaft 207 may be rotatably supported in part, or entirely, by a pair of brackets 210 that each includes a sleeve 212 in which a respective portion of the shaft 207 resides. The shaft 207 may additionally, or alternatively, be rotatably supported by bearings 214. In the illustrated embodiment, the bearing 214 is configured to fit onto, and rotatably support, the shaft 207. The driven gear 206 is fixed to the bearing 214, such as by a press fit or interference fit for example, so that the driven gear 206 and bearing 214 rotate in unison with each other. When positioned on the shaft 207, the bearing 214 abuts the sleeve 212 of the bracket 210.

In at least some embodiments the bearings 214 each take the form of a roller clutch, such as a one-way locking needle-roller bearing clutch for example. In general, roller clutches are configured to transmit a torque to the shaft 207 in one rotational direction and move freely relative to the shaft 207 in the opposite rotational direction. In neutral, a roller clutch may have a low frictional torque, which may prevents drive system losses and save energy. Depending upon the embodiment, the bearings 214 may be configured to support thrust loading in addition to rotary loading.

In general, the bearings 214 are each configured and arranged so that only the drive gear 202*a* causes rotation of the roller 208 when the lid 104 is depressed, and only the drive gear 202*b* causes rotation of the roller 208 as the lid 104 returns to the 'ready' position. More specifically, each of the two bearings 214, one at either end of the shaft 207, is configured and arranged so that an associated driven gear 206 rotates freely relative to the shaft 207 as that driven gear 206 is rotated in a first direction, and that driven gear 206 imparts rotation, by application of a torque, to the shaft 207 when that driven gear 206 is rotated in a second direction that is opposite the first direction.

That is, and with reference first to the drive gear 202*a*, the driven gear 206 rotates freely relative to the shaft 207 as the driven gear 206 is rotated in a first direction by the downward movement of the drive gear 202*a* in response to depression of the lid 104. As such, the downward movement of the drive gear 202*a*, in response to depression of the lid 104, does not impart any rotary motion to the shaft 207, even though the drive gear 202*a* is engaged with the driven gear 206. On the other hand, upward movement of the drive gear 202*a*, as the lid 104 moves to the 'ready' position, applies a torque that imparts a rotary motion to the shaft 207 so that the shaft 207 rotates in a wipe dispensing direction.

The drive gear 202*b* and driven gear 206 on the right hand side of the wipe dispensing system 100, as viewed from the perspective of FIG. 3 for example, operate in the reverse fashion of drive gear 202*a* and its corresponding driven gear 206 on the left hand side of the wipe dispensing system 100. That is, as the lid 104 is depressed, the drive gear 202*b*, engaged with the driven gear 206, applies a torque so as to rotate the shaft 207 in a wipe dispensing direction. On the other hand, upward movement of the drive gear 202*b*, as the lid 104 moves to the 'ready' position, does not impart any rotary motion to the shaft 207, even though the drive gear 202*b* is engaged with the driven gear 206. Instead, that driven gear 206 rotates freely relative to the shaft 207 due to the presence of the bearing 214 (not shown) inside the driven gear 206 that is engaged with the drive gear 202*b*.

Figure 10:
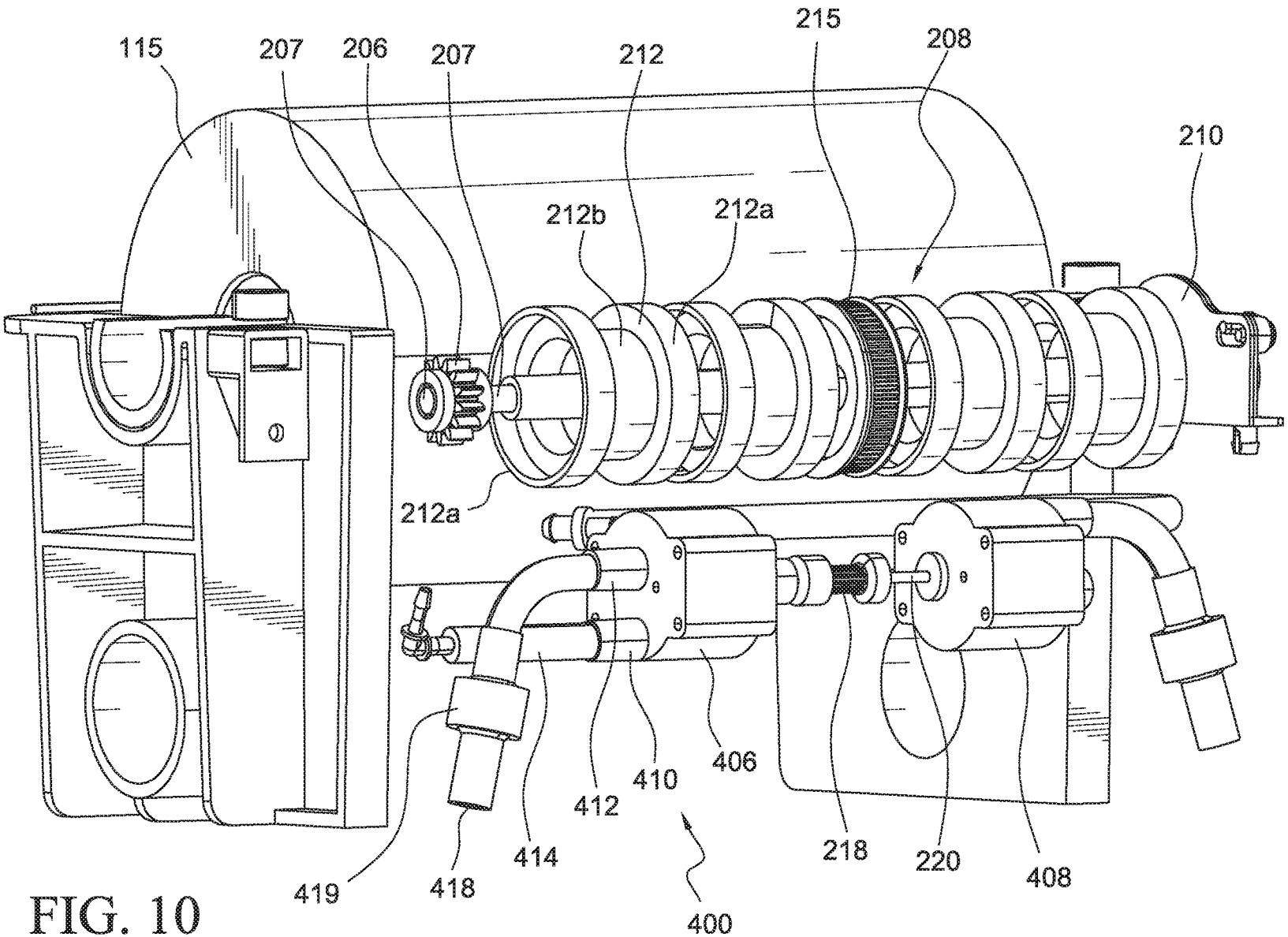
FIG. 10 is a front perspective view with the lid and housing removed and disclosing various components of a wipe dispensing system.
Figure 11:
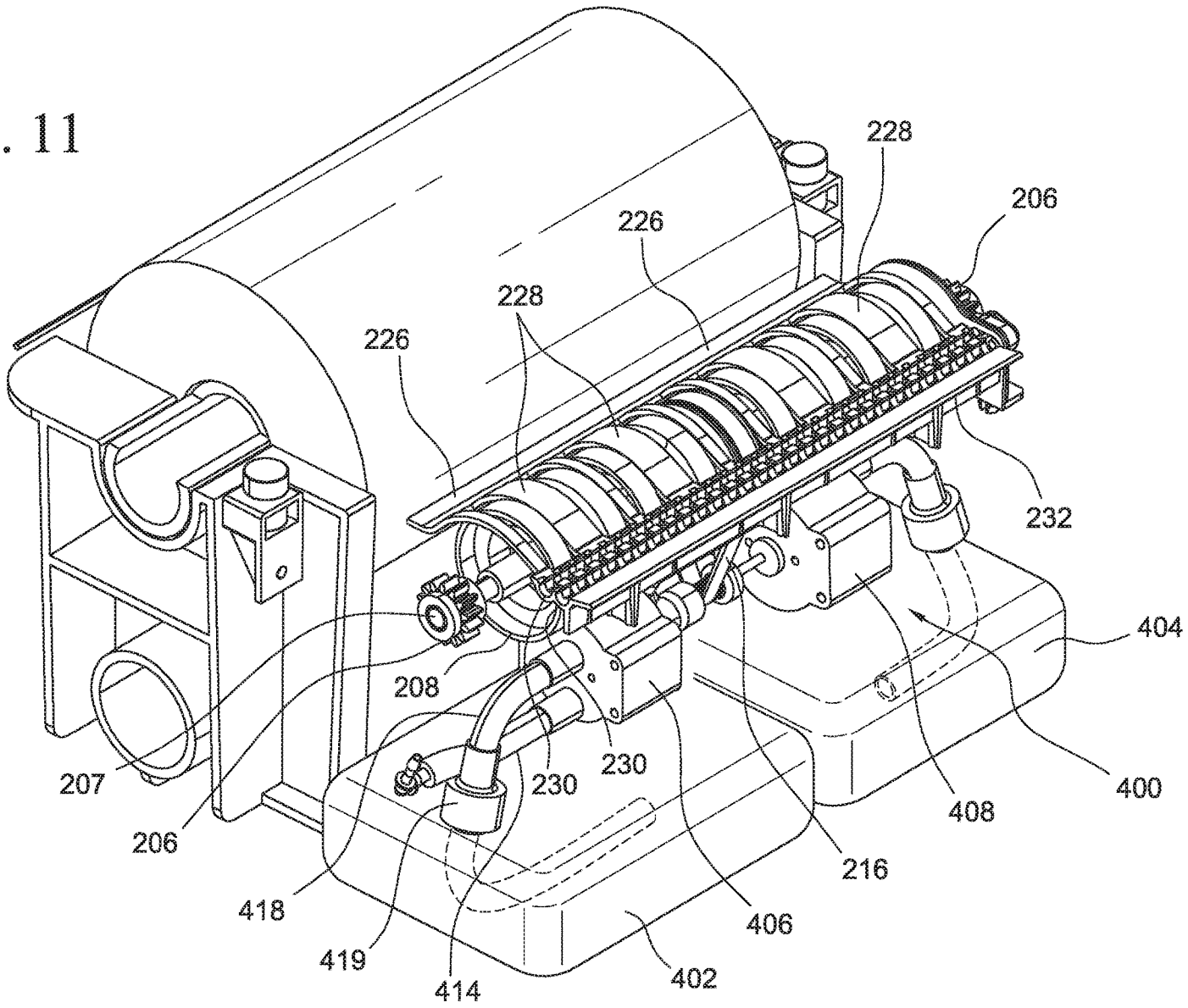
FIG. 11 is a top perspective view with the lid and housing removed and disclosing various components of a wipe dispensing system.
Figure 12:
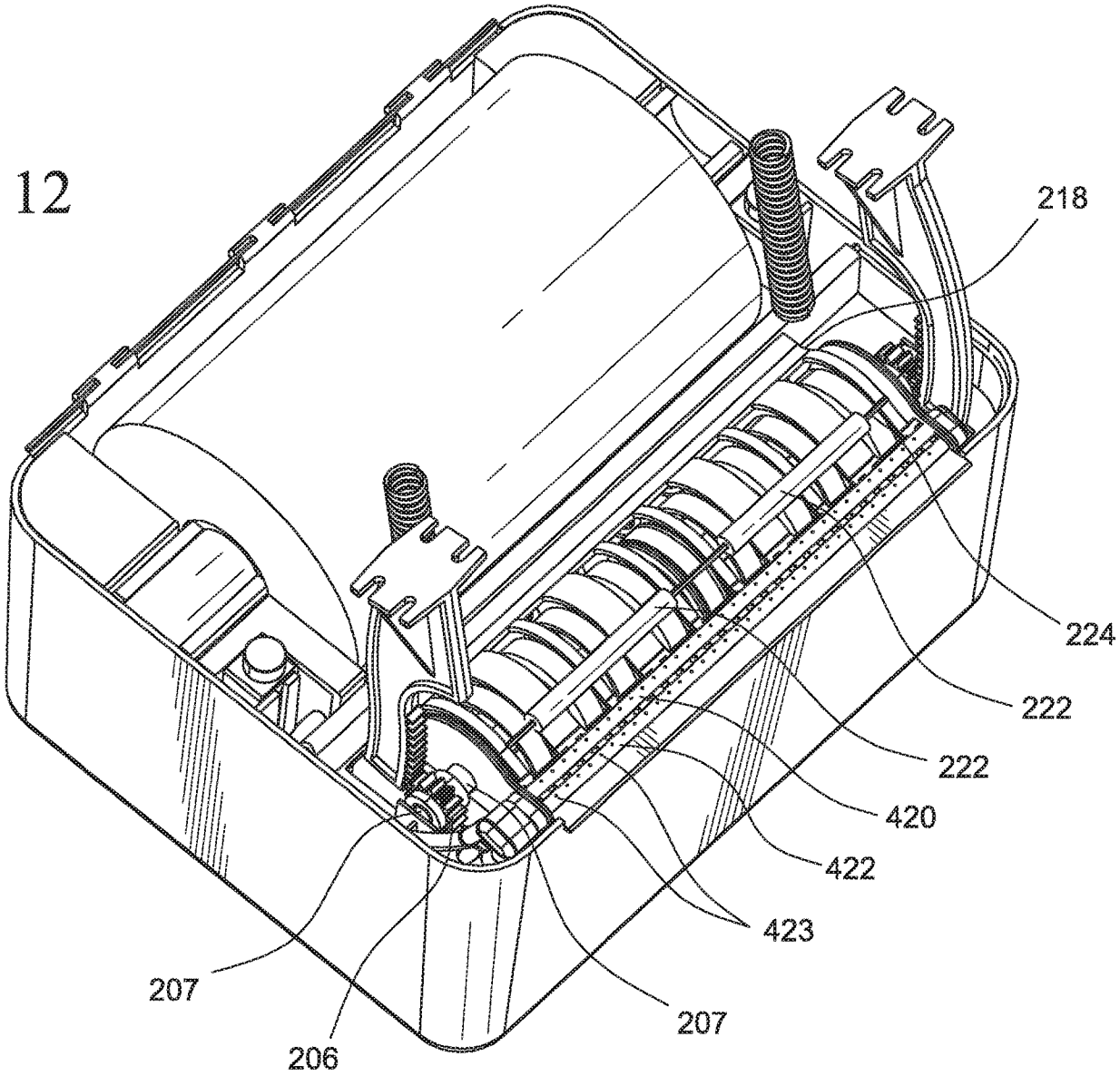
FIG. 12 is a top view, with the lid removed, of various fluid system components of a wipe dispensing system.
Figure 13:
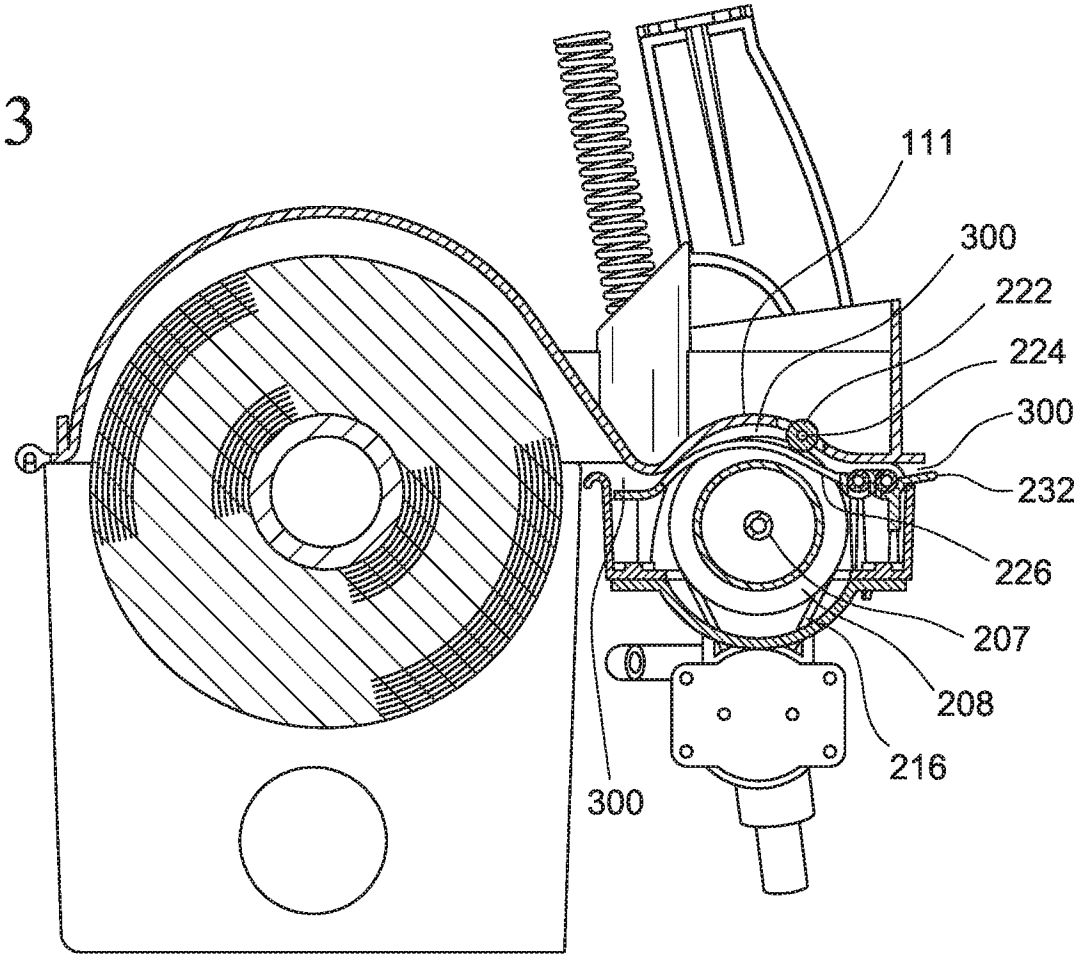
FIG. 13 is a section view of various fluid system components and wipe dispensing system components of a wipe dispensing system.
Figure 14:
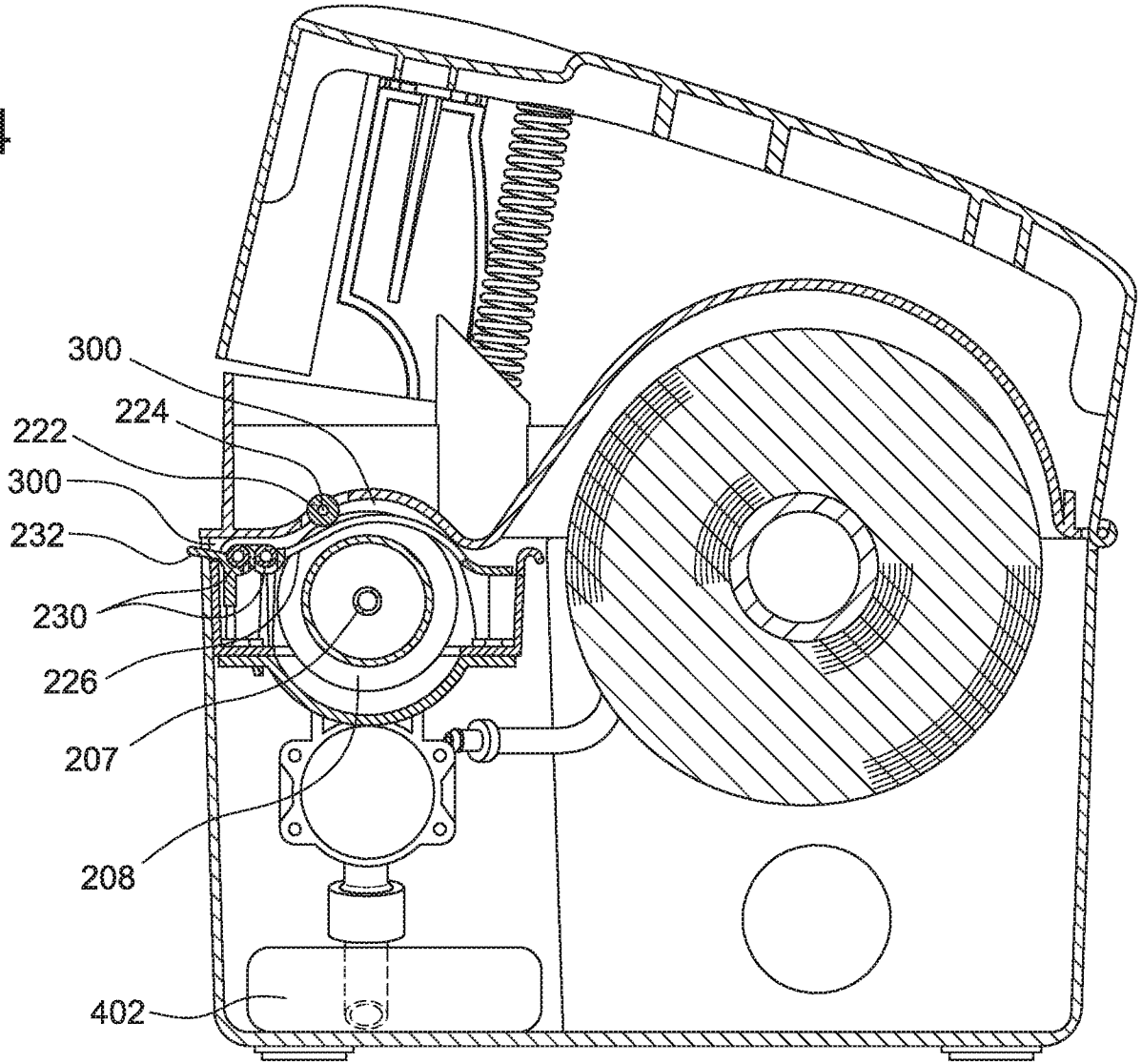
FIG. 14 is another section view of various fluid system components and wipe dispensing system components of a wipe dispensing system.
Figure 15:
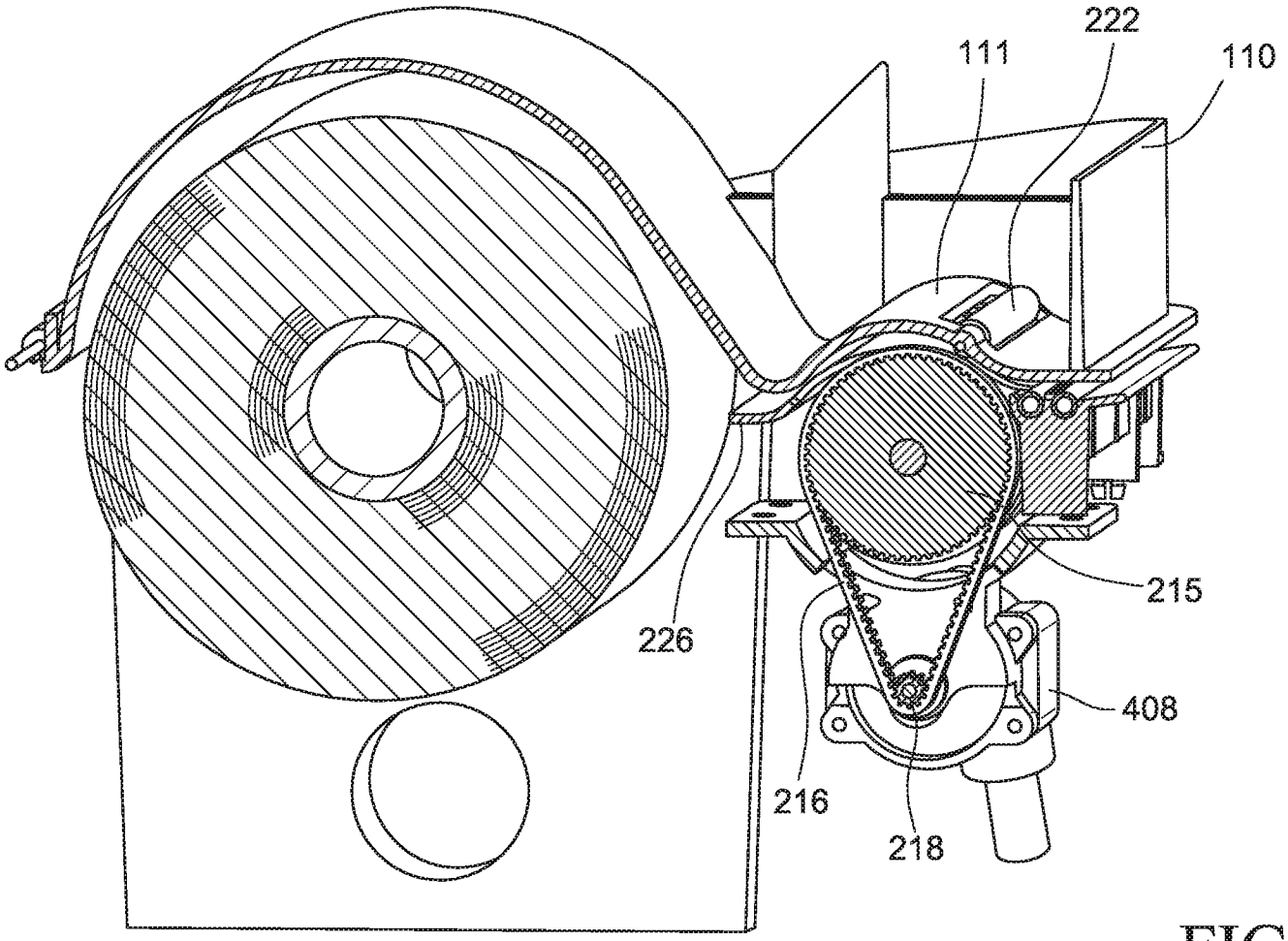
FIG. 15 is a side perspective view of various fluid system components and wipe dispensing components of a wipe dispensing system.

Turning now to FIGS. 10-12, further details are provided concerning an example embodiment of the roller 208, and various associated components. As shown in those Figures, the roller 208 may comprise one or more roller tube elements 212 mounted on the shaft 207. In the illustrated embodiment, four roller tube elements 212 are employed, although more or fewer roller tube elements 212 can be employed in other embodiments. In general, the roller tube elements 212 define part of a wipe dispensing path 300, shown in FIGS. 13 and 14 as disclosed in further detail elsewhere herein.

Two or more of the roller tube elements 212 may be connected to each other so as to rotate in unison with each other, or one or more of the roller tube elements 212 may rotate independently of one or more of the other roller tube elements 212. The roller tube elements 212 may be symmetric about an axis defined by the shaft 207, but that is not required. As shown, the roller tube elements 212 may take a spool configuration in which the end portions 212*a* of the roller tube elements 212 have a larger outside diameter than the outside diameter of a middle portion 212*b*. Other configurations may alternatively be employed however. In some embodiments, two or more of the roller tube elements 212 can be locked together, in pairs for example, and then pressed onto the shaft 207.

The spool configuration of example roller tube elements 212 may help to self-center a wipe, laterally, in the wipe dispensing path 300 as the wipe is dispensed. As well, the configuration and arrangement of the roller tube elements 212 may also help prevent, or reduce the likelihood of, the wipe getting stuck on the roller 208 as the wipe moves along the wipe dispensing path 300. In particular, the spool configuration of roller tube elements 212 provides for a relative reduction in the surface area of the roller 208 that comes into contact with the wipe, which reduces the likelihood that the wipe will become stuck on the spool 208.

In connection with their configuration and operation as part of a wipe dispensing mechanism, and their role in defining part of a wipe dispensing path 300, one or more of the roller tube elements 212 may, but need not, include a coating or surface treatment, such as rubber or silicone for example, that is positioned along the wipe dispensing path 300 and arranged for contact with a wipe as it travels along the wipe dispensing path 300. In other embodiments, the coating or surface treatment can include a material that includes a grit, such as 400 G sandpaper for example, or other materials with comparable properties. The roller tube elements 212 themselves can be made of plastic or other materials, and in one embodiment, the roller tube elements 212 may be constructed with a substrate comprising cellulose and polypropylene, and the substrate may have a top coat or layer of one of the materials noted above, such as sandpaper, rubber, silicone, or comparable materials, or any combinations of these materials.

In general, the friction between the roller tube elements 212 and/or coating/layer on the roller tube elements 212 and the wipe enables the roller 208 to advance the wipe along the wipe dispensing path 300, and the friction may also provide sufficient tension that a user can detach the dispensed wipe with the use of a cutter, or alternatively with perforations in the wipe. However, some embodiments employ a cutter (not shown) that a user can employ to cut a dispensed wipe, and/or such embodiments may employ a roll of wipes 115 that comprise perforated wipes. In one particular embodiment, the cutter takes the form of blade that travels along a track that crosses the wipe dispensing path 300 so that the user can cut the wipe by moving the blade across the wipe dispensing path 300.

With particular reference now to FIGS. 10 and 11, the example roller 208 may additionally include a drive gear 215 that is mounted to the shaft 207 and rotates in unison with the shaft 207. The drive gear 215 may be connected directly or indirectly by way of a belt 216, to a driven gear 218 that is connected to a pump shaft, or pump shafts, 220. In brief, as the drive gear 215 of the roller 208 rotates under the influence of one or the other of the driven gears 202*a* or 202*b*, the pump shaft(s) 220 are likewise caused to rotate in unison with the roller 208, by virtue of the belt 216 connecting the drive gear 215 with the driven gear 218, to operate one or more elements of a fluid dispensing system 400, such as one or more fluid pumps 406 and 408 (discussed below).

It will be appreciated from the present disclosure that by the selection and implementation of gears of various sizes and configurations, desired effects can be achieved with respect to the rate at which fluid is discharged from a fluid pump, the rate at which a wipe is dispensed, and the volume per unit length at which a wipe may be dosed. Such gears include the aforementioned driven gear 218, drive gear 215, drive gear 202*a*, drive gear 202*b*, and the driven gears 206.

Turning now to various other components of the wipe dispensing system 100, and with reference to FIGS. 12-15, one or more tensioners 222 may be provided that are mounted to a shaft 224 that is supported at either end by the housing extension 110 such that when the housing extension 110 is closed, as shown in FIG. 1 for example, the tensioners 222 are brought downward into contact with a wipe that resides in the wipe dispensing path 300. More specifically, the tensioners 222 may be configured and arranged to contact one or more end portions 212*a* of one or more roller tube elements 212 when there is no wipe disposed in the wipe dispensing path 300. The shaft 224 may be biased downward toward the wipe dispensing path 300, for example, by one or more resilient elements (not shown). Alternatively, these resilient elements may be omitted. The tensioners 222 are configured to rotate relative to the shaft 224 as a wipe moves past the tensioners 222 along the wipe dispensing path 300. In the illustrated example, two tensioners 222 are provided, but more, or fewer, tensioners may be employed in other embodiments.

Like the roller tube elements 212, one or more of the tensioners 222 may comprise may include a coating or surface treatment, such as rubber or silicone for example, that is positioned along the wipe dispensing path 300 and arranged for contact with a wipe as it travels along the wipe dispensing path 300. The friction between the tensioners 222 and the wipe enables the roller 208 to advance the wipe along the wipe dispensing path 300. As well, the friction between the tensioners 222 and the wipe may also provide sufficient tension in a wipe that the wipe tends to resist being withdrawn from the housing 102. Thus, a user may be able to pull on the wipe and detach the dispensed wipe without necessitating the use of a cutter, or perforations in the wipe.

With particular reference now to FIGS. 11 and 13-15, a manifold support element 226 may be provided that is supported by the brackets 110 and positioned above the roller 208 so as to define part of the wipe dispensing path 300. As indicated, the manifold support element 226 is positioned beneath a clamshell portion 111 of the floor of the housing extension 110, such that the manifold support element 226 and the clamshell portion 111 respectively define an upper, and lower, portion of part of the wipe dispensing path 300. In general, and as discussed in further detail elsewhere herein, the manifold support element 226 serves to support and retain a manifold that doses one or more fluids onto a wipe passing along the wipe dispensing path 300.

In more detail, and as best shown in FIG. 11, the manifold support element 226 may comprise a plurality of curved wipe guide elements 228 that are spaced apart from each other in such a way so as to interleave with portions of one or more roller tube elements 212, such as the end portions 212*a*. The wipe guide elements 228, or portions of the wipe guide elements 228, may also be positioned below an uppermost surface of one or more of the roller tube elements 212. This configuration enables the manifold support element 226 to be mounted over the roller 208 without interfering with the operation of the roller tube elements 212, or with the movement of a wipe along the wipe dispensing path 300.

As well, the manifold support element 226 further defines one or more channels 230 that extend laterally along a widthwise direction of the housing 102. In general, each of the channels 230 supports a respective manifold (discussed below) that is in fluid communication with a discharge side of one of the fluid pumps 406 and 408. The manifold support element 226 may further include an upward extending lip 232 that may help to contain any excess dosing fluid within the housing 102, that is, dosing fluid that is not absorbed by a passing wipe.

C. Aspects of an Example Fluid Dispensing System

With continued attention to FIGS. 1-15, and particularly FIGS. 4-7 and 10-12, details are provided concerning fluid dispensing systems employed in various embodiments of the invention, where one example of such a fluid dispensing system is denoted generally at 400. As best indicated in FIG. 5, some or all of the components of the fluid dispensing system 400 are disposed in the housing 102, beneath the housing extension 110. However, the scope of the invention is not limited to this configuration and arrangement of fluid dispensing system 400 components and, in other embodiments, any one or more of such components may be located elsewhere in the wipe dispensing system 100, such as on the housing extension 110, or between the housing extension 110 and the lid 104. Thus, the arrangement disclosed in the figures is presented only by way of example.

In general, the fluid dispensing system 400 includes multiple fluid reservoirs 402 and 404 (see, e.g., FIG. 5), disposed within the volume collectively defined by the housing 102, lid 104, and housing extension 110. In some example embodiments, two fluid reservoirs are provided, although more or fewer fluid reservoirs can be used. The fluid reservoirs 402 and 404 are configured to hold a volume of fluid and are isolated from each other so that fluid in one of the fluid reservoirs 402 or 404 cannot enter the other fluid reservoir 402 or 404. This may be important in cases where the efficacy of a fluid mixture that includes both fluids is limited in time. Thus, by keeping the fluids separate from each other until the time of dispensing, the efficacy time of the fluid combination is maximized. For example, wipes may be dosed with relatively higher pH solutions, than the desired pH of the fluid mixture at the time of dispensing, since the mixing of the component dosing fluids is delayed as long as possible. In this way, incompatible chemistries can be employed together in an efficacious manner.

As well, the fluid reservoirs 402 and 404 can be removable from the wipe dispensing system 100 for refilling or disposal. In general, the fluid reservoirs 402 and 404 can be removed and replaced, and/or may be removed, refilled, and then reinstalled in the wipe dispensing system 100. The fluid reservoirs 404 and 402, as well as their operation and interaction with other elements of the wipe dispensing system 100 may be configured and arranged to include or incorporate any one or more of the following features and elements: little or no leakage from the fluid reservoirs occurs when the fluid reservoirs are installed, during use of the fluid reservoirs, or during removal of the fluid reservoirs; the fluid reservoirs are securely held in place during use; the fluid reservoirs and corresponding structure(s) of the fluid dispensing system 400 that interface with the fluid reservoirs are configured and arranged such that there is only single possible way to install/remove the fluid reservoirs 402/404 in/from the housing 102 and connect/disconnect the fluid reservoirs 402/404 to/from other elements of the fluid dispensing system 400; the fluid reservoirs 402/404 are configured to auto-align with corresponding structural elements of the housing 102 during installation so as to enable proper connection of the fluid reservoirs 402/404 with other elements of the fluid dispensing system 400; the fluid reservoirs 402/404 are configured to provide feedback, which may be one or more of tactile, audible, or visible feedback, to the user that fluid reservoir 402/404 is properly connected to the structure of the housing 102 and to the fluid dispensing system 400; the fluid reservoirs 402/404 are equipped with a vacuum breaker and/or other connection that allows air to enter the fluid reservoir 402/404 during use; and, the fluid reservoirs 402/404 are configured so that when installed in the housing 102 and connected to the fluid dispensing system 400, the respective liquids held in the fluid reservoir 402 and fluid reservoir 404 are kept separate from each other until dispensed by the fluid dispensing system 400.

The fluid dispensing system 400 further includes multiple pumps, such as pumps 406 and 408. Each pump 406 and 408 is arranged for fluid communication with a respective fluid reservoir 402 and 404. In general, the pumps 406 and 408 serve to pump fluid from the fluid reservoirs 402 and 404, respectively, to a location where the fluids are dosed onto a wipe. Any suitable pump can be employed, and the pump and its components can be made of any material(s) compatible with the fluid to be pumped, examples of which include any type of plastic.

In one example embodiment, one or both of the pumps 406 and 408 is a Bellows Metering Pump manufactured by GRI. Details concerning these example pumps are disclosed in Appendix A hereto, which is incorporated herein in its entirety by this reference. In another example embodiment, one or both of the pumps 406 and 408 may be a Priming Diaphragm Pump Spray Motor 12V for Water Dispenser by UXCELL: Amazon Part Number a13120400ux0009; UPC 700724662064; EAN 0700724662064, 7241870949775; Module Number: a13120400ux0009; UNSPSC Code 26100000; Max Flow—2-3 L/Min; Outlet Max Pressure—1-2.5 Kg; Hmax—1-25M; Water Hole Dia.—9.2 mm/0.36"; Total Size—85×40×32 mm/3.3"×1.6"×1.2" (L*W*H); Material—Metal and Plastic. This pump may be modified by removing the motor and connecting the pump shaft, directly or indirectly, to the driven gear 218. Any other suitable pumps could be substituted however. For example, diaphragm pumps may be employed in some embodiments of the invention, while other embodiments of the invention may employ peristaltic pumps.

It should be noted that while the following discussion is directed to pump 406, the configuration and arrangement of pump 408 can be similar, or identical, to that of pump 406. Thus, the following discussion is equally applicable to pump 408. As shown in the Figures, the pump 406 includes a suction connection 412 and a discharge connection 410. A pump suction line 418 connects the fluid reservoir with the suction connection 412. A backflow preventer 419, such as a check valve, for example, is provided in the pump suction line 418 to prevent backflow of fluid from the pump suction line 418 into the fluid reservoir. A pump discharge line 414 connects the pump discharge connection 410 with a fluid discharge manifold 420 that is configured and arranged to direct discharged fluid from the pump 406 onto a wipe as the wipe is dispensed from the wipe dispensing system 100. Another fluid discharge manifold 422 is provided that is in fluid communication with the pump discharge line of the pump 408. The suction connection line 418 may include a flow control device or backflow preventer 419 to limit the discharge flow rate from the pump 406 in the event that the roller 208 speed, and thus, the pump discharge volume, exceeds a permissible limit. In some embodiments, one or both of the fluid discharge manifolds 420 and 422 can be omitted and the fluid dispensing system 400 can be configured with other fluid dispensing devices, such as respective arrays of nozzles for example.

As indicated in FIG. 12, for example, each of the fluid discharge manifolds 420 and 422 may include a plurality of holes 423 or other perforations by way of which pressurized fluid from the pumps 406 and 408, respectively, can be dosed onto a wipe. The size, shape, orientation, and/or spacing of the holes 423 can be selected as needed to suit a particular application. In one embodiment, the holes 423 are generally circular, although that shape is not required. In the particular example of FIG. 12, the fluid discharge manifolds 420 and 422 are disposed in series relative to each other, such that a wipe first passes over the fluid discharge manifold 420 and then over the fluid discharge manifold 422. As also indicated in FIG. 12, the fluid discharge manifolds 420 and 422 are located in close proximity to each other, so as to help ensure even mixing of the respective fluids while, and after, they are dispensed onto the wipe.

Turning now to FIGS. 5 and 12-14 in particular, further details are provided concerning the example fluid dispensing system 400. As shown, the fluid discharge manifolds 420 and 422 of the fluid dispensing system 400 is positioned proximate the wipe dispensing path 300. This configuration and arrangement enables the fluid discharge manifolds 420 and 422 to direct fluid onto a wipe disposed in the wipe dispensing path 300. In more detail, the fluid discharge manifold 420 and the fluid discharge manifold 422 each discharge, simultaneously or nearly so, a respective fluid component onto a passing wipe. In this way, the components do not mix with each other until such time as they are dosed onto the wipe.

It should be noted that the fluid pump 406 and 408 flow rates, flow control or backflow preventer 419 selection/configuration, and/or fluid discharge manifold 420/422 configurations can be used to implement a desired dispensed concentration of one fluid relative to the other. To illustrate, the discharge flow rate of the fluid pump 406 may be selected to be 3× the discharge flow rate of fluid pump 408, so as to provide a Fluid A/Fluid B dispensed mixture concentration of 3:1. As another example, the fluid discharge area defined by the holes 423 of one of the fluid discharge manifolds may be 2× the fluid discharge area defined by the holes 423 of the other fluid discharge manifold. Since Q=vA (where Q is flow rate, v is velocity of the fluid, and A is the discharge area), such a discharge manifold configuration would (assuming a constant discharge velocity for both fluid discharge manifolds) provide a Fluid A/Fluid B dispensed mixture concentration of 2:1.

With respect to their materials, the components of the fluid dispensing system 400 may comprise plastic, rubber, such as silicone rubber for example, metal, such as steel or aluminum for example, or any combination of these. For example, the tubing used for the fluid pump 406/408 suction and discharge lines 418 and 414 may comprise silicone rubber tubing. The scope of the invention is not limited to any particular material, or materials, for any particular component. More generally, the components of the fluid dispensing system 400 should be resistant to chemical attack by the fluids employed with the fluid dispensing system.

D. Operation of a Wipe Dispensing System

With reference to the various Figures discussed above, details are now provided concerning some operations of an example wipe dispensing system. Initially, the wipe dispensing system can be in a 'ready' state where the wipe dispensing system is able to dispense a wipe on demand. See, e.g., FIG. 1, in which the lid is biased upward into the indicated position. In the 'ready' state, the wipe is positioned in the wipe path such that a leading edge of the wipe that will be dispensed is located proximate the outlet of the fluid discharge manifold. As well, when the wipe dispensing system is in the 'ready' state, a volume of fluid may reside in a pump discharge line between the pump and a fluid discharge manifold.

As noted herein, the respective discharge flow rates provided by each fluid pump can be the same, or may be different. This is likewise true with respect to other fluid system components such as the fluid discharge manifolds, and the flow control devices. Thus, dosing ratios for multiple fluids, enable the chemistry of a particular fluid, or combination of fluids, may be tuned, for example, to a desired pH, color, and/or concentration.

In any case, the user can then depress the lid of the wipe dispensing system, overcoming the bias imposed by one or more springs, for example, on the lid. As described earlier, the downward movement of the lid causes the roller to rotate and advance the wipe along the wipe path. At, or about, the same time, the rotation of the roller, which may be mechanically connected to one or more fluid discharge pumps, causes the fluid discharge pumps to pump respective fluids to the corresponding fluid discharge manifolds, which then direct the fluid to the wipe as the wipe passes over the fluid discharge manifolds. Thus, operation of the fluid discharge pumps is effected by the downward movement of the lid.

Thus, in example embodiments of the invention, a wipe may be dosed, by one or more liquids, and dispensed at the same time, or about the same time, by a single operation of the user, namely, a depression of the lid. Moreover, the lid is returned automatically to a 'ready' position after it is released by the user at the conclusion of a dosing and dispensing event. As discussed below, there may be multiple possible modes of operation of the wipe dispensing system. Particularly, Table 1 below discloses 3 different modes of operation, along with the characteristics of the wipe substrate that would be adequate to support each particular mode of operation.

TABLE 1

| | Mode 1 Push, Push | Mode 2 Push once, then pull one wipe | Mode 3 Push once, then pull multiple wipes |
|---|---|---|---|
| User operation | Push lid to feed towel out of the dispenser. | Push the lid once to feed the wipe tail out of the dispense, then user pulls on this wipe tail to dispense rest of one single wipe. Next wipe stays inside the dispenser ready for the next push of the lid to dispense the tail. | Push the lid once to feed the wipe tail out of the dispenser then pull on this wipe tail to dispense this wipe and multiple wipes behind it. |
| Substrate characteristics | Substrate perforation strength is low to make tearing of wipe easy. | Substrate perforation is lower than force required to engage rollers when pulling the wipe out of dispenser. Therefore, this will ensure that when the perforation gets to the roller it will tear. This gives one-wipe-at-a-time dispensing. | Substrate perforation is higher than force required to engage rollers when pulling wipe out of the dispenser. Therefore, when pulling on the first wipe, the next wipe (and other as desired) stays attached and dispenses as well. |

With regard to the volume of fluid(s) dispensed during a wipe dispensing event, that volume may be partly, or exclusively, a function of the length of the wipe that is dispensed. That is, as disclosed herein, the fluid pumps may continue to operate so long as the roller is in motion. The roller, in turn, may remain in motion until the user has dispensed a wipe of the desired length. Thus, embodiments of the invention enable the user to dispense a wipe of any desired length, where the length may not be determined until the time of dispensing, with assurance that the wipe will be continuously and consistently dosed during the dispensing process, regardless of how long the dispensed wipe is.

As explained in the present disclosure, including the foregoing discussion concerning aspects of the operation of the lid 104 and its components, lid 104 is an example structural implementation of a means for causing simultaneous on-demand dosing and dispensing of a wipe. Moreover, such a means is responsive to user input, that is, this means can cause performance of the dosing and dispensing functions in response to a single user action, such as depression of the lid. Other functions performed by such a means also include simultaneous operation of two or more pumps, and operation of a wipe dispensing system.

As well, the disclosed embodiments of a wipe dispensing system are example structural implementations of a means for dispensing a wipe. Moreover, such a means is responsive to user input, that is, this means can dispense the wipe in response to a single user action, such as depression of the lid. This function of dispensation of the wipe can be performed on-demand as a result of the user input, and can be performed simultaneous with dosing of the wipe, such as by a fluid dispensing system.

As well, the disclosed embodiments of a fluid dispensing system are example structural implementations of a means for dosing a wipe. Moreover, such a means is responsive to user input, that is, this means can dose the wipe in response to a single user action, such as depression of the lid. This function of dosing of the wipe, which can involve one, two, or more, fluids, can be performed on-demand as a result of the user input, and can be performed simultaneous with dispensing of the wipe, such as by a wipe dispensing system. As well, such a means produces a dosed wipe whose length may not be determined until the time that the wipe is dispensed by the user. Thus, a user is not constrained to dispense multiple wipes, nor is the user required to dispense one or more wipes of predetermined length. Finally, the means may produce a wipe that is dosed at a consistent volume of fluid, which includes fluid combinations, per linear unit of wipe substrate, regardless of the speed with which the wipe is dispensed from the wipe dispensing unit.

With respect to the various aforementioned means, it is noted that the foregoing structures are provided only by way of example, and any other structure(s) of comparable functionality may alternatively be employed.

E. Aspects of Some Example Methods

Figure 16:
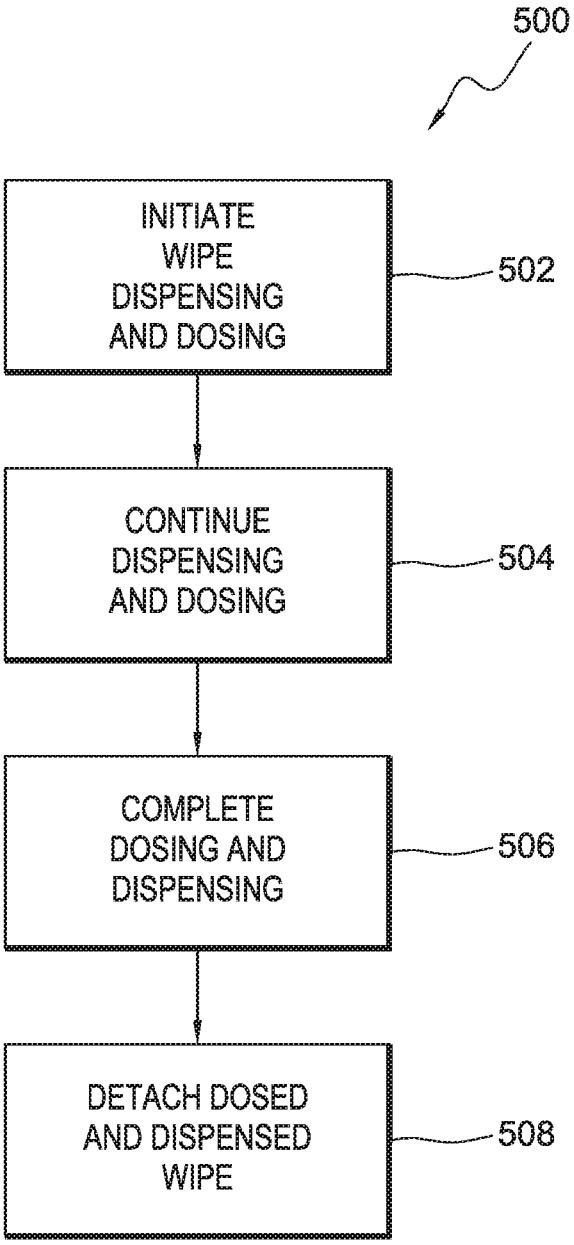
FIG. 16 is a flow diagram disclosing aspects of an example method of use for an on demand wet wipe dispensing system.

With continued reference to the Figures, and directing attention now to FIG. 16, details are provided concerning a method of use of an example wipe dispensing system, where one example of such a method is denoted generally at 500. The method 500 can provide for on-demand dosing and dispensing of one or more wipes.

The method 500 can begin when dispensation of a wipe is initiated 502. This initiation 502 can occur when, for example, a user begins to depress a lid of a wipe dispensing system. The wipe may be dry, or un-dosed, prior to the initiation 502 of the dispensation of the wipe. Simultaneously with, or at about the same time as, initiation 502 of the dispensation of the wipe, dosing of the wipe may begin.

After initiation 502 of the wipe dispensation and dosing, the user can continue to depress the lid of the wipe dispensing system so as to continue 504 the dispensing and dosing processes. If the user should stop the downward motion of the lid prior to full dosing and dispensation of the wipe, or release the lid so that the lid returns to the 'ready' position, the dosing and dispensing of the wipe will cease unless or until such time as the user begins to press the lid downward. The wipe may be progressively dosed by one or more fluids as a result of the dispensation of the wipe 504 from the wipe dispensing system. Thus, the process 504 can involve movement of a wipe that is wet in one portion, such as the portion that has passed by the fluid discharge manifold, and dry in another portion, such as the portion that has not passed by the fluid discharge manifold.

At 506, the user can complete the dosing of the wipe and the dispensation of the wipe from the wipe dispensing system. In some embodiments, completion of the dispensation of the wipe refers to a state in which most, or all, of the dosed wipe, extends out of the housing of the wipe dispensing system, such as when the user has fully depressed the lid of the wipe dispensing system. At this juncture, the wipe has been dosed with one or more fluids such that a substantial portion of the wipe has been wetted with the fluid(s). Thus, the process 506 can involve completion of the dispensation of a fully dosed wipe from the wipe dispensing system. When the wipe has been fully dosed and dispensed, the user can then grasp the wipe and detach it 508 from the next succeeding wipe. In at least some embodiments, the detachment takes place inside the housing while, in other embodiments, detachment takes place outside the housing such that a tail of the wipe extends from the housing.

As will be apparent from the foregoing, the processes 502, 504 and 506 can be caused by a single user action, namely, full depression of the lid of the wipe dispensing system. Moreover, those processes can all be performed without requiring the user to touch, grasp, tear, pull, or otherwise manipulate, the wipe before it is completely dosed and dispensed. As well, it should be noted that the lid of the wipe dispensing system can be fully depressed repeatedly to dose and dispense a succession of wipes, which can remain attached to each other, or which can be detached from each other by a user. Alternatively, the lid of the wipe dispensing system can be held down in the fully depressed position and a wipe of desired length withdrawn from the wipe dispensing system, and then detached by the user. Further information concerning other operational modes is disclosed in Table 1 herein.

F. Example Wipe Materials and Fluid Chemistries

In connection with embodiments such as those disclosed herein, a variety of different wipe substrate materials and dosing fluids can be employed. The scope of the invention is not limited to any particular substrate materials, dosing fluids, or combinations of these and, as such, the substrate materials and fluids discussed below are provided only by way of illustration, and not limitation.

Some general examples of wipe substrates include one or more of the following, in any combination: dry (un-dosed); wet (pre-dosed); dry (pre-dosed); wet or dry pre-dosed with fluid(s) and/or particles; synthetic; non-synthetic, such as cellulose for example; and, blends of synthetic and non-synthetic. Some particular embodiments of the invention allow the use of, for example, cellulose wipes with oxidants that are currently not possible due to chemical and/or wipe degradation. In at least some embodiments, the wipe substrate is inert and chemically neutral with respect to the fluids, individually and/or in combination, that are expected to be dispensed on it.

As noted herein, embodiments of the invention may be advantageous in that, for example, the wipe dispensing system enables new chemistry that can be delivered onto a surface by a wipe. The chemical combinations are enabled as the fluids are mixed as the wipe is dispensing, therefore the fluids are in contact with each other for a substantially shorter period of time than in the case of traditional wet wipes.

In addition, embodiments of the invention implement the separation of both fluids from the wipe until the time that the wipe is dispensed. As a result, the problem of modification of the fluid when stored with the wipe over a long period of time is avoided. As an example, sodium hypochlorite exhibits higher stability at a relatively high pH. However, the micro efficacious profile of sodium hypochlorite is lower at the higher pH. Thus, example embodiments of the invention enable the activation of stable sodium hypochlorite into the less stable, yet highly efficacious, hypochlorous acid.

Sample formula 1:

| Ingredient | Examples | Range of Wt % Active |
|---|---|---|
| | Fluid A | |
| Alkali Hypochlorite | Sodium Hypochlorite | 0.20-1.0% |
| Alkaline Buffer | Sodium Carbonate, Sodium Hydroxide | 0.01-1.0% |
| Water DI | | Balance |
| | Fluid B | |
| pH Regulators | Sodium Citrate, Citric Acid Anhydrous, Succinic Acid | 0.20-1.5% |
| Organic Slashing Agent | Sodium Citrate Dihydrate, Citric Acid Anhydrous, Succinic Acid | 0.30-0.90% |
| Surfactants/ Hydrotropes | Sodium Xylene Sulfonate, Decyl (Sulphophenoxy) Benzene Sulphonic Acid, Disodium Salt | 0-2.0% |
| Fragrance | | 0-0.10% |
| Water DI | | Balance |

Sample formula 2:

| Ingredient | Examples | Range of Wt. % Active |
|---|---|---|
| | Fluid A | |
| Alkali Hypochlorite | Sodium Hypochlorite | 0.20-1.0% |
| Alkaline Buffer | Sodium Carbonate, Sodium Hydroxide | 0.01-1.0% |
| Water DI | | Balance |
| | Fluid B | |
| Buffer | Sodium Bicarbonate | 0.10-1.0% |
| Inorganic Slashing Agent | Sodium Nitrite, Sodium Thiosulfate | 0.30-0.90% |
| Surfactants/ Hydrotropes | Sodium Xylene Sulfonate, Decyl (Sulphophenoxy) Benzene Sulphonic Acid, Disodium Salt | 0-2.0% |
| Fragrance | | 0-0.10% |
| Water DI | | Balance |

Sample formula 3:

| Ingredient | Examples | Range of Wt. % Active |
|---|---|---|
| | Fluid A | |
| Water DI | | 100% |
| | Fluid B | |
| Peracetic Acid | | 0.20-1.0% |
| Peroxide | Hydrogen Peroxide | 0.30-0.90% |
| Acetic Acid | | 2-5.0% |
| Surfactants/ Hydrotropes | Secondary Alkane Sulfonates, Alcohol Ethoxylates, EO/PO Surfactants | 0-2.0% |
| Solvent | Monohydric Alcohols | 0-2.0% |
| Fragrance | | 0-0.10% |

Alternatives to the described fluid components above are an oxidant in one fluid reservoir, with organic components in a water based fluid in a second fluid reservoir. Example organic components include, but are not limited to fragrances, surfactant, and polymers. Another multi-fluid combination that is enabled by example embodiments of the invention is chemistry that is stable as a concentrate but desired use is as a diluted version. Still other multi-fluid combinations that may be employed in some embodiments of the invention include bleach (Fluid A)+citric acid (Fluid B), and bleach (Fluid A)+hydrogen peroxide (Fluid B).

It should be noted that as used here, the term 'fluid' is intended to be broad in scope. As such, that term embraces any material, and any combination of two or more materials, that can be employed by a fluid dispensing system, examples of which are disclosed herein. Moreover, materials of various viscosities and other properties can be used. As such, examples of materials include fluids having a room temperature viscosity about the same as water, as well as lotions, slurries, soaps, ointments, and other materials whose room temperature viscosity may be greater than that of water.

Where combinations of materials are employed in an embodiment, any ratio or percentage of those materials can be employed. By way of illustration, if two fluids are employed in an embodiment, the percentage (e.g., by volume) of the first fluid can be anywhere in the range of about 1% to about 99% and, accordingly, the percentage (e.g., by volume) of the second fluid can be anywhere in the range of about 99% to about 1%.

As will be apparent from the foregoing discussion and examples, the wipe dispensing system can be configured to dispense a fluid combination whose pH is different from the respective pH values of the constituent components. For example, where one of the components is relatively stable bleach, that component can be combined with one or more other fluids at about the time that dispensation of the wipe is initiated. The combined fluid thus produced can have a pH that renders it more effective than the bleach component alone.

The present invention may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. A wipe dispensing system, comprising:

a housing defining a wipe storage area;

a lid connected to the housing;

first and second fluid reservoirs disposed within the housing;

first and second fluid pumps in fluid communication with the first and second fluid reservoirs, respectively;

a roller operably connected with the lid and with the first and second fluid pumps and wherein the roller is responsive to movement of the lid; and first and second fluid discharge manifolds in fluid communication with the first and second fluid pumps, respectively, and located proximate a wipe dispensing path that communicates with the wipe storage area, wherein when fluid is present in one or both of the first and second fluid reservoirs, rotation of the roller causes one of the first and second fluid pumps to discharge fluid from one of the first and second fluid discharge manifolds, and one of the first and second fluid pumps continues to discharge fluid from one of the first and second fluid discharge manifolds, respectively, while the roller is rotating and wherein a return of the lid from a depressed position to a 'ready' position causes one of the fluid pumps to discharge fluid from the one of the fluid discharge manifolds, and also causes dispensation of portion of a wipe from the housing.

2. The wipe dispensing system as recited in claim 1, wherein when a first fluid is present in the first fluid reservoir, and a second fluid is present in the second fluid reservoir, the first fluid and the second fluid do not mix with each other until they are dispensed from the first and second fluid discharge manifolds, respectively.

3. The wipe dispensing system as recited in claim 1, wherein the wipes in the roll of wipes are unperforated.

4. The wipe dispensing system as recited in claim 1, wherein the wipes in the roll of wipes are perforated.

5. The wipe dispensing system as recited in claim 1, wherein a combination of the first and second fluids has higher efficacy for a relatively shorter period of time than the first and second fluids employed separately from each other, and wherein the first and second fluids retain their potency for a relatively longer period of time when stored separately from each other than when combined with each other.

* * * * *